US007555242B2

(12) United States Patent
Zensai

(10) Patent No.: US 7,555,242 B2
(45) Date of Patent: Jun. 30, 2009

(54) IMAGE FORMING APPARATUS HAVING DRIVE SYSTEM ACCORDING TO LOADS

(75) Inventor: Shoichi Zensai, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 428 days.

(21) Appl. No.: 11/495,763

(22) Filed: Jul. 31, 2006

(65) Prior Publication Data

US 2007/0031166 A1 Feb. 8, 2007

(30) Foreign Application Priority Data

Aug. 3, 2005 (JP) ..... 2005-226044
Jul. 28, 2006 (JP) ..... 2006-206710

(51) Int. Cl.
*G03G 15/00* (2006.01)
*G03G 15/01* (2006.01)

(52) U.S. Cl. ..... 399/167; 399/299

(58) Field of Classification Search ..... 399/167, 399/298, 299, 301–303
See application file for complete search history.

(56) References Cited

U.S. PATENT DOCUMENTS 6,795,671 B2 9/2004 Matsuoka ..... 399/223
6,889,022 B2 * 5/2005 Ehara et al. ..... 399/167
7,031,642 B2 * 4/2006 Abe ..... 399/167
7,239,829 B2 * 7/2007 Tanaka ..... 399/167

FOREIGN PATENT DOCUMENTS

JP 2003-43781 2/2003
JP 2003-208024 7/2003
JP 2004-205688 7/2004
JP 2005-265951 9/2005

* cited by examiner

*Primary Examiner*—William J Royer
(74) *Attorney, Agent, or Firm*—Fitzpatrick, Cella, Harper & Scinto

(57) ABSTRACT

An image forming apparatus includes a plurality of image bearing members for forming toner images, a plurality of driven members respectively acting on the plurality of image bearing members, wherein, the plurality of image bearing members including plural first image bearing members and a second image bearing member which is different from the plural first image bearing members. In a first mode, the toner image is formed on each of the plural first image bearing members and the second image bearing member. In a second mode, the toner image is not formed on the plural first image bearing members and the toner image is formed on the second image bearing member, a first drive device which drives the plural first image bearing members, and a second drive device which drives the second image bearing member, the driven member which acts on the second image bearing member and at least one of the driven members which act on the plural first image bearing members. Such an image forming apparatus is capable of suppressing an image misalignment among the image bearing members with a reduced cost, and capable of equalizing the drive loads for the plurality of drive sources.

21 Claims, 21 Drawing Sheets

IMAGE FORMING APPARATUS HAVING DRIVE SYSTEM ACCORDING TO LOADS

BACKGROUND OF THE INVENTION

1. Field of the Invention

The present invention relates to an image forming apparatus utilizing an electrophotographic process, such as a printer, a copying apparatus or a facsimile apparatus, and more particularly to a drive of an image bearing member or a driven member acting on the image bearing member.

2. Description of the Related Art

As an image forming apparatus utilizing for example an electrophotographic process, there is known a color image forming apparatus of so-called in-line type including a plurality of image forming parts, each including an electrophotographic photosensitive member (hereinafter referred to as "photosensitive member") constituting an image bearing member, and process means which acts on such photosensitive member. In the image forming apparatus of such in-line type, images on the photosensitive member are transferred in succession onto an intermediate transferring member disposed in opposition to the plurality of image forming parts or onto a transfer material on a transfer material bearing member. In general, the plurality of image forming parts are constituted of four image forming parts for respectively forming images of yellow, magenta, cyan and black colors, and a drum-shaped member is used as the photosensitive member (4-drum tandem type).

Also in the image forming apparatus of such in-line type, it is known to integrally construct the photosensitive member and the process means such as developing means, in each image forming part, as a process cartridge, that is rendered detachably mountable in a main body of the image forming apparatus. In such process cartridge system, for example when a developer is used up, the user himself can replace the process cartridge without relying on a service personnel to enable image formation again. Also other consumable parts such as the photosensitive member may also be replaced at the same time, whereby the maintenance ability can be significantly improved.

As an example, an image forming apparatus of the aforementioned 4-drum tandem system will be explained below. Currently, a "4-motor system" as shown in FIG. 18 is commonly employed, in which four photosensitive members 1*a*, 1*b*, 1*c* and 1*d* are driven by respective motors 101*a*, 101*b*, 101*c* and 101*d*.

Also a "1-motor system" as shown in FIG. 19 is employed, in which all four photosensitive members 1*a*, 1*b*, 1*c* and 1*d* are driven by a single motor 101.

In the "1-motor system", an electronic clutch or a mechanical clutch mechanism is utilized for switching over a full-color mode and a mono-color mode. The full-color mode is a multicolor mode in which all four photosensitive members 1*a*, 1*b*, 1*c* and 1*d* are driven, while the mono-color mode is a monochromatic mode in which for example a photosensitive member 1*d* for black color only is driven. The "1-motor system" has an advantage in cost, in comparison with the "4-motor system".

The "4-motor system" tends to become costly, because of an increased number of motors. Also the "4-motor system" may lead to an increased installation space and an increased weight in the structure, and may hinder realizing a compact and low-cost image forming apparatus.

On the other hand, the "1-motor system" may cause an unevenness in the rotation of the photosensitive member, depending on the precision of meshing in the clutch mechanism, thereby conspicuously causing a color misalignment or a banding phenomenon (periodical unevenness in image by a fluctuation in the rotation of the photosensitive member).

Japanese Patent Application Laid-open No. 2003-43781 discloses a technology of driving photosensitive drums for yellow, magenta and cyan colors with a first motor, and driving a photosensitive drum for black color with a second motor.

However, in the technology of Japanese Patent Application Laid-open No. 2003-43781, the first motor also drives developing rollers corresponding to the photosensitive drums driven by the first motor, and the second motor also drives a developing roller corresponding to the photosensitive drum driven by the second motor, and does not pay attention to a driving load relating to the photosensitive drum and the developing roller.

SUMMARY OF THE INVENTION

An object of the present invention is to provide an image forming apparatus capable, with a reduced cost, of suppressing an image displacement on an image bearing member and equalizing drive loads for plural drive sources.

Another object of the present invention is to provide an image forming apparatus including a plurality of image bearing members on each of which a toner image is formed, said plurality of image bearing members including plural first image bearing members and a second image bearing member which is different from said plural first image bearing members, a plurality of driven members respectively each of which acts on each of said plurality of image bearing members, wherein, in a first mode, the toner image is formed on each of said plural first image bearing members and said second image bearing member, and in a second mode, the toner image is not formed on said plural first image bearing members and the toner image is formed on said second image bearing member, a first drive device which drives said plural first image bearing members, and a second drive device which drives said second image bearing member, the driven member which acts on said second image bearing member and at least one of the driven members which act on said plural first image bearing members.

Further features of the present invention will become apparent from the following description of exemplary embodiments with reference to the attached drawings.

DESCRIPTION OF THE EMBODIMENTS

Figure 1:
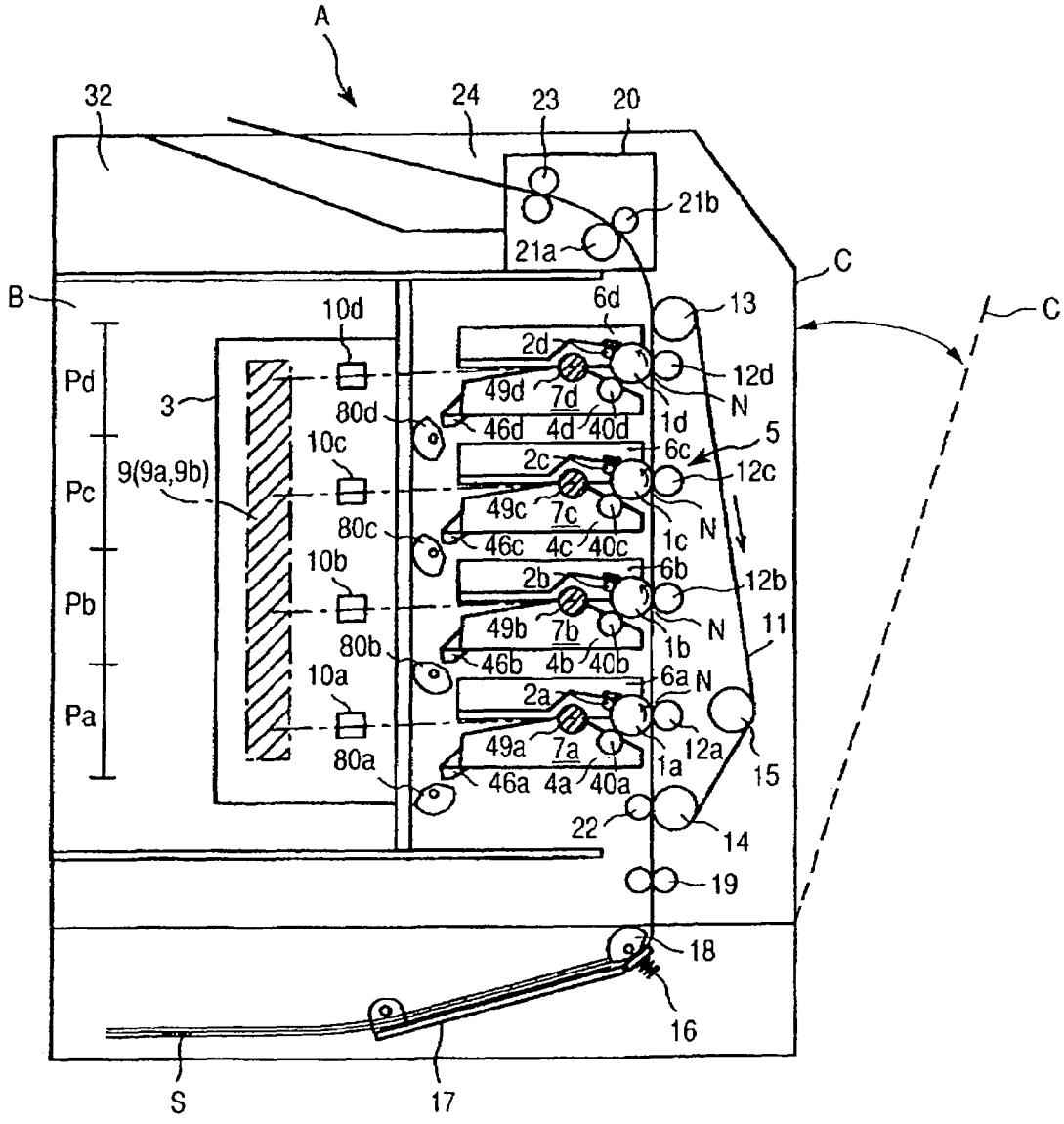
FIG. 1 is a view showing an image forming apparatus embodying the present invention.

Now an image forming apparatus of the present invention will be explained in detail, with reference to the accompanying drawings.

Embodiment 1

Entire Structure

At first, an entire structure of the image forming apparatus will be explained with reference to FIG. 1, which is a longitudinal cross-sectional view, showing an entire structure of an image forming apparatus A of the present embodiment. The image forming apparatus A of the present embodiment is a full-color laser beam printer capable, in response to an image information signal and utilizing an electrophotographic process, of forming a full-color image on a transfer material (such as a recording paper or an OHP sheet), constituting a recording material. The image information signal is transmitted from an external apparatus such as a personal computer, an image reading apparatus or a digital camera, rendered capable of wired or wireless communication with a main body B of the apparatus. However, the present invention is not restricted to such forms but may be realized in any arbitrary form such as a copying apparatus or a facsimile.

The image forming apparatus A is provided, as image forming means, with four image forming parts Pa, Pb, Pc and Pd. In the present embodiment, the image forming parts Pa, Pb, Pc and Pd are the same in structure and functions, except that toners used therein are different in colors thereof.

The image forming parts Pa, Pb, Pc and Pd are equipped, as image bearing members, with four drum-shaped photosensitive members or photosensitive drums 1*a*, 1*b*, 1*c* and 1*d*, which are disposed in a parallel manner, along a substantially vertical direction. The photosensitive drums are rotated, counterclockwise in FIG. 1, by a drive device shown in FIG. 11, as will be explained in more detail later.

Around the photosensitive drums 1*a*, 1*b*, 1*c* and 1*d* and along the rotating direction thereof, there are provided charging members 2*a*, 2*b*, 2*c* and 2*d*, constituting charging devices for uniformly charging the surface of the photosensitive drums 1*a*, 1*b*, 1*c* and 1*d*, and a scanner unit 3 constituting an exposure device for irradiating the photosensitive drums 1*a*, 1*b*, 1*c* and 1*d* with laser beams based on image information, thereby forming electrostatic latent images on the photosensitive drums 1*a*, 1*b*, 1*c* and 1*d*. Also at a downstream side, there are provided developing devices (developing units) 4*a*, 4*b*, 4*c* and 4*d* for depositing toners of developers onto the electrostatic latent images thereby forming toner images, and an electrostatic transfer device 5 for transferring the toner images on the photosensitive drums 1*a*, 1*b*, 1*c* and 1*d* onto a transfer material S. At a further downstream side, cleaning devices (cleaning units) 6*a*, 6*b*, 6*c* and 6*d*, for removing residual toners remaining on the photosensitive drums 1*a*, 1*b*, 1*c* and 1*d* after the transfer step, are provided.

In the present embodiment, the four image forming parts Pa, Pb, Pc and Pd, including the photosensitive drums 1*a*, 1*b*, 1*c* and 1*d*, the charging members 2*a*, 2*b*, 2*c* and 2*d*, the scanner unit 3, the developing devices 4*a*, 4*b*, 4*c* and 4*d* and the cleaning devices 6*a*, 6*b*, 6*c* and 6*d*, form images of respectively different colors (yellow, magenta, cyan and black). In the following description, yellow color is represented as Y, magenta as M, cyan as C and black as Bk.

In the present embodiment, the photosensitive drum, the charging device, the developing device and the cleaning device are integrally formed as a cartridge, thus constituting process cartridges 7*a*, 7*b*, 7*c* and 7*d*. The process cartridges 7*a*, 7*b*, 7*c* and 7*d* are detachably mounted in the main body B of the apparatus, by mounting means such as guide grooves 34A1, 34A2, 34A3, 34A4, 34B1, 34B2, 34B3 and 34B4 to be explained later (cf. FIG. 3). The process cartridge is not limited to the form of the present embodiment, but may be so constructed as to include, as an integral cartridge, a photosensitive drum and at least one of a charging device, a developing device and a cleaning device as the process means acting on the photosensitive drum, and as to be detachably mountable in the main body of the apparatus.

In the following, each component of the image forming apparatus A will be explained in detail, making reference also to FIG. 2, which is a longitudinal cross-sectional view of a process cartridge.

In the following description, a front side of the image forming apparatus A means a side from which the process cartridges are inserted into the main body B of the apparatus, namely a right-hand side in FIG. 1. Also right or left side of the image forming apparatus A is defined as the apparatus is seen from the front side.

The photosensitive drum 1*a*, 1*b*, 1*c* or 1*d* is an OPC photosensitive drum, formed by coating an external periphery of an aluminum cylinder having a diameter for example of 25 mm, with an organic photoconductor layer. The photosensitive drum 1*a*, 1*b*, 1*c* or 1*d* is rotatably supported, at both ends thereof, by support members. The photosensitive drum 1*a*, 1*b*, 1*c* or 1*d* is rotated in a direction X in FIG. 2 (counterclockwise) by a driving power transmitted to an end thereof from a drive motor (cf. FIG. 11), as will be explained later in more details detail.

The charging devices 2*a*, 2*b*, 2*c* and 2*d* may be of contact charging type, including charging members in contact with the photosensitive drums 1*a*, 1*b*, 1*c* and 1*d*. The present embodiment employs, as charging members, conductive rollers (charging rollers) 2*a*, 2*b*, 2*c* and 2*d* having a roller shape. The surfaces of the photosensitive drums 1*a*, 1*b*, 1*c* and 1*d* are uniformly charged by contacting the charging rollers 2*a*, 2*b*, 2*c* and 2*d* with the surfaces of the photosensitive drums 1*a*, 1*b*, 1*c* and 1*d* and applying a charging bias voltage to the charging rollers 2*a*, 2*b*, 2*c* and 2*d*.

Figure 3:
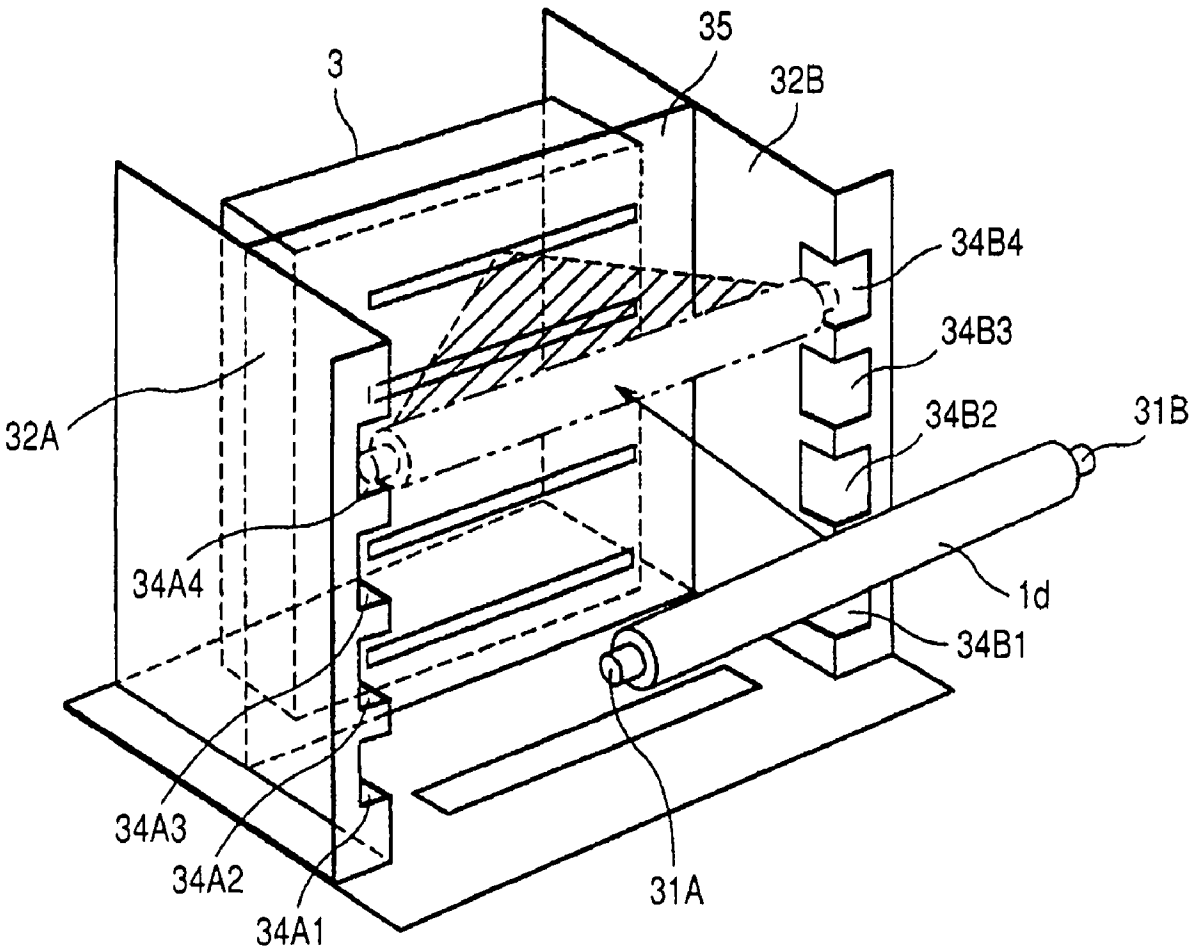
FIG. 3 is a view showing a mounting operation of a process cartridge into a main body of the apparatus.

The scanner unit 3 is provided at an approximately horizontal direction to the photosensitive drums 1*a*, 1*b*, 1*c* and 1*d*. In the present embodiment, for each photosensitive drum, a single laser diode (not shown) emits an image light corresponding to the image signal. The image light irradiates a polygon mirror 9, rotated at a high speed by a scanner motor (not shown). The polygon mirror is provided, for example, for every two photosensitive drums. The present embodiment has two polygon mirrors, namely a first polygon mirror 9*a* and a second polygon mirror 9*b*. The first polygon mirror 9*a* is used for causing a scanning motion of the light irradiating the image forming parts Pa, Pb for forming the images of Y and M colors, and the second polygon mirror 9*b* is used for causing a scanning motion of the light irradiating the third and fourth image forming parts Pc, Pd for forming the images of C and Bk colors. The image light reflected by the polygon mirror 9 selectively exposes the surface of the already charged photosensitive drum, through an imaging lens 10*a*, 10*b*, 10*c* or 10*d* provided respectively on the photosensitive drum 1*a*, 1*b*, 1*c* or 1*d*. In this manner, an electrostatic latent image, corresponding to the image signal, is formed on the photosensitive drum 1*a*, 1*b*, 1*c* and 1*d*. As shown in FIG. 3, the scanner unit 3 is constructed, in the longitudinal direction of the photosensitive drums 1*a*, 1*b*, 1*c* and 1*d* (in the axial direction thereof), shorter than a pitch between side plates 32 (left side plate 32A and right side plate 32B). The scanner unit 3 is mounted on an intermediate frame 35, which stands and is positioned between the left and right side plates 32A, 32B.

The developing devices 4*a*, 4*b*, 4*c* and 4*d* are provided with toner containers 41, serving as developer containers for containing developers of Y, M, C and Bk colors respectively (in the present embodiment, negatively chargeable non-magnetic one-component developers (toners)). The toner container 41 includes a developing roller 40*a*, 40*b*, 40*c* or 40*d* serving as a developer carrying member, a developer carrying mechanism 42, a toner supply roller 43 serving as a developer supply member, and a developing blade 44 serving as a developer regulating member. The toner in the toner container 41 is fed by the carrying mechanism 42 to the toner supply roller 43. The toner is applied, by the toner supply roller 43 and the developing blade 44 contacted with the external periphery of the developing roller 40*a*, 40*b*, 40*c* or 40*d*, onto the external periphery of the developing roller 40*a*, 40*b*, 40*c* or 40*d*, and is given an electrostatic charge. The toner supply roller 43 rotates in a direction Z in FIG. 2 (clockwise). Also the developing roller 40*a* rotates in a direction Y in FIG. 2 (clockwise). A developing bias is applied to the developing roller 40*a*, opposed to the photosensitive drum 1*a* bearing an electrostatic latent image, whereby the toner is supplied onto the photosensitive drum 1*a* according to the latent image.

In the present embodiment, a transfer belt (electrostatic transfer belt) 11 is provided as a transfer material conveying member, which cyclically moves so as to be opposed to and to contact all the photosensitive drums 1*a*, 1*b*, 1*c* and 1*d*. The transfer belt 11 electrostatically sucks and conveys the transfer material S. The transfer belt 11 is constituted of a film-shaped member of a thickness of about 110 μm having a volume resistivity of $10^{11}$ to $10^{14}$ Ω·cm. The transfer belt 11 is supported in a vertical direction by rollers of 3 axes. The transfer belt 11 electrostatically sucks the transfer material S on the external periphery at the left-hand side in FIG. 1, and cyclically moves so as to bring the transfer material S in contact with the photosensitive drums 1*a*, 1*b*, 1*c* and 1*d*. Thus the transfer material S is conveyed, by the transfer belt 11, to transfer parts (transfer positions) N opposed to the photosensitive drums 1*a*, 1*b*, 1*c* and 1*d*.

Also in positions respectively opposed to the 4 photosensitive drums 1*a*, 1*b*, 1*c* and 1*d*, transfer rollers 12*a*, 12*b*, 12*c* and 12*d* are provided, in parallel, as transfer devices so as to be in contact with the inner periphery of the transfer belt 11. These transfer rollers 12*a*, 12*b*, 12*c* and 12*d* apply, across the transfer belt 11, positive charges to the transfer material S. By electric fields formed by such charges, the negatively charged toner images on the photosensitive drums 1*a*, 1*b*, 1*c* and 1*d* are transferred onto the transfer material S contacted with the photosensitive drums 1*a*, 1*b*, 1*c* and 1*d*.

In more detail, the transfer belt 11 of the present embodiment is formed by an endless belt having a peripheral length of about 560 mm and a thickness of 110 μm, which is supported by 3 rollers, including a drive roller 13, an idler roller 14 and a tension roller 15. The transfer belt 11, by a driving power transmitted to the drive roller 13 from a drive source, is cyclically moved (rotated) in a direction indicated by an arrow (clockwise) in FIG. 1. Thus, while the transfer material S is conveyed from the side of the idler roller 14 toward the side of the drive roller 13 by the cyclic movement of the transfer belt 11, the toner images are transferred onto the transfer material S.

Also there may result a situation where the transfer material S is not supplied by an unexpected reason and the toner remains on the transfer belt 11. In the present embodiment, in such a situation, the transfer belt 11 is rotated faster with a certain peripheral speed difference between the photosensitive drums 1*a*, 1*b*, 1*c* and 1*d* and the transfer belt 11. By such operation, the toner on the transfer belt 11 can be efficiently transferred to the photosensitive drums 1*a*, 1*b*, 1*c* and 1*d* and recovered by the cleaning devices 6*a*, 6*b*, 7*c* and 6*d* in the process cartridges 7*a*, 7*b*, 7*c* and 7*d*, whereby the transfer belt 11 can be cleaned.

A feed unit 16 serves to supply and convey the transfer material S to the image forming parts Pa, Pb, Pc and Pd, and contains plural transfer materials S in a feed cassette 17. At an image forming operation, a feed roller 18 (D-shaped roller) and paired registration rollers 19 are driven in rotation in response to the image forming operation. The transfer materials S in the feed cassette 17 are separated and fed one by one by the feed roller 18, and a leading end of the transfer material S impinges on the paired registration rollers 19 to form a loop. Thereafter the transfer material S is fed, so as to be in synchronization with a predetermined image start position, by the paired registration rollers 19 to the transfer belt 11. Also in a position opposed to the idler roller 14, an electrostatic suction roller 22, for electrostatic attraction of the transfer material S onto the transfer belt 11, is contacted with the transfer belt 11.

A fixing part 20 as a fixing device fixes the unfixed toner image, transferred onto the transfer material S, onto the transfer materials. The fixing part 20 includes a pair of rotated fixing rollers (a heat roller 21*a* and a pressure roller 21*b* pressed thereto), and applies, in the contact part thereof, heat and a pressure to the transfer material S. Thus the transfer material S, having received the transfer of the toner images from the photosensitive drums 1*a*, 1*b*, 1*c* and 1*d*, is conveyed, in passing through the fixing part 20, by the paired fixing rollers 21*a*, 21*b*. In this operation, the transfer material S receives heat and a pressure by the paired fixing rollers 21*a*, 21*b*. Thus, for example in a multi-color mode to be explained later, toner images of plural colors are fixed onto the transfer material S.

In the following description, an image forming operation will be explained, by a full-color image formation as an example. The process cartridges 7*a*, 7*b*, 7*c* and 7*d* are activated in succession, according to the timings of image formation (operations of forming images to be recorded on the transfer material S), and, in response to such activations, the photosensitive drums 1*a*, 1*b*, 1*c* and 1*d* are rotated in directions indicated by arrows shown in FIG. 1 (counterclockwise). Also the scanner unit 3 is activated in response to the operations of the process cartridges 7*a*, 7*b*, 7*c* and 7*d*. More specifically, at first the charging rollers 2*a*, 2*b*, 2*c* and 2*d* provide the peripheries of the photosensitive drums 1*a*, 1*b*, 1*c* and 1*d* with uniform charges, and then the scanner unit 3 provides exposures corresponding to the image signals on the peripheries of the photosensitive drums 1*a*, 1*b*, 1*c* and 1*d*.

Thus electrostatic latent images are formed on the peripheries of the photosensitive drums 1*a*, 1*b*, 1*c* and 1*d*. The developing rollers 40*a*, 40*b*, 40*c* and 40*d* in the developing devices 4*a*, 4*b*, 4*c* and 4*d* transfer the toners to a low-potential part of the electrostatic latent images. Thus toner images are formed (developed) on the peripheries of the photosensitive drums 1*a*, 1*b*, 1*c* and 1*d*. Subsequently, a leading end of the toner image, formed on the periphery of the photosensitive drum 1*a* at a most upstream side in the conveying direction of the transfer material S, is brought by rotation to a position substantially opposed to the transfer belt 11. The paired registration rollers 19 feed the transfer material S to the transfer belt 11, in such a manner that, at such timing, a recording start position of the transfer material S coincides with such opposed position.

The transfer material S is, being pinched between the electrostatic suction roller 22 and the transfer belt 11, pressed to the external periphery of the transfer belt 11. Also by a voltage application between the transfer belt 11 and the electrostatic suction roller 22, charges are induced in the transfer materials, constituted of a dielectric material, and a dielectric layer of the transfer belt 11, whereby the transfer material S is electrostatically sucked onto the external periphery of the transfer belt 11. Thus the transfer material S is stably attracted to the transfer belt 11, and is conveyed to the transfer part N of the most downstream photosensitive drum 1*d*. In the conveying of the transfer material S, by the electric fields formed between the photosensitive drums 1*a*, 1*b*, 1*c* and 1*d* and the transfer rollers 12*a*, 12*b*, 12*c* and 12*d*, the toner images on the photosensitive drums 1*a*, 1*b*, 1*c* and 1*d* are transferred in succession onto the transfer material S. The transfer material S, having received the transfers of toner images of 4 colors, is separated by the curvature of the belt drive roller 13 (curvature separation) from the transfer belt 11, and is conveyed to the fixing part 20. The transfer material S, after being subjected to a thermal fixation of the toner image in the fixing part 20, is discharged by paired discharge rollers 23, in a state with an image bearing surface downward, onto a discharge part 24 outside the main body B of the apparatus A.

(Process Cartridge)

The process cartridge 7*a* will be explained below in more detail. FIG. 2 shows a principal cross section of a process cartridge 7*a*, containing toner. The process cartridges 7*a*, 7*b*, 7*c* and 7*d* for Y, M, C and Bk colors have the same structure, so that the process cartridge 7*a* alone will be explained and the explanation of the other process cartridges 7*b*, 7*c* and 7*d* will be omitted.

The process cartridge 7*a* is divided into a photosensitive member unit 50, containing a photosensitive drum 1*a*, a charging roller 2*a* and a cleaning device 6*a*, and a developing unit 4*a*, including for example a developing roller 40*a* for developing the electrostatic latent image on the photosensitive drum 1*a*. In the photosensitive member unit 50, the photosensitive drum 1*a* is rotatably supported, by bearings (left bearing 31A and right bearing 31B) (cf. FIG. 3), in a cleaning frame member 51 constituting a casing of the photosensitive member unit 50. Along the periphery of the photosensitive drum 1*a*, there are provided the charging roller 2*a* for uniformly charging the surface of the photosensitive drum 1*a*, and a cleaning blade 60 serving as a cleaning member for removing the toner (residual toner) remaining on the photosensitive drum 1*a* after the transfer step. The residual toner, removed by the cleaning blade 60 from the surface of the photosensitive drum 1*a*, is carried in succession, by a used toner carrying mechanism 52 to a used toner chamber 53. The used toner chamber 53 is provided behind the cleaning frame member 51. The photosensitive drum 1*a* receives a drive power, at an end (rear side of the plane of FIG. 2) of the longitudinal direction (in the direction of the rotary axis of the photosensitive drum 1*a*), from a drive source provided in the main body B of the apparatus (cf. FIG. 11). Thus the photosensitive drum 1*a* is rotated, along the image forming operation, in a direction X in FIG. 2 (counterclockwise).

Figure 2:
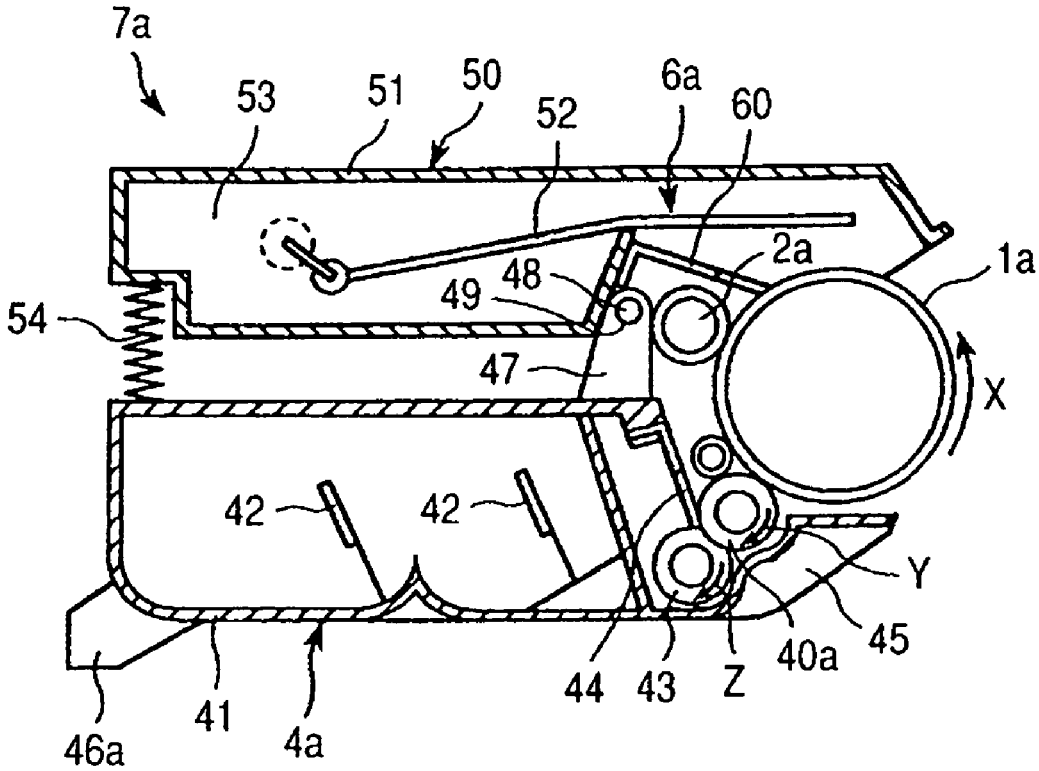
FIG. 2 is a cross-sectional view of a process cartridge.

The developing unit 4*a* includes a developing roller 40*a* which is contacted with the periphery of the photosensitive drum 1*a* at the image formation and is rotated in a direction Y (clockwise) shown in FIG. 2, and a toner container 41 which contains the toner. The developing unit 4*a* further includes a toner supply roller 43 which is contacted with the periphery of the developing roller 40*a* and is rotated in a direction Z (clockwise) shown in FIG. 2, and a developing blade 44 contacted with the periphery of the developing roller 40*a*. The developing unit 4*a* further includes a carrying mechanism 42 which agitates the toner contained in the toner container 41 and carries the toner to the toner supply roller 43, and a development frame member 45 constituting a casing of the developing unit 4*a*. The developing roller 40*a* is rotatably supported, by bearing members, in the development frame member 45. The development frame member 45 serves as supporting means for the developing roller 40*a*. In the present embodiment, the photosensitive drum 1*a*, the developing roller 40*a* and the toner supply roller 43 have substantially parallel rotary axes.

The developing unit 4*a* is supported, about supporting shafts 49 respectively provided in bearing members 47 which are mounted on both ends of the longitudinal direction of the developing roller 40*a* (direction of rotary axis of the developing roller 40*a*), in such a manner that the entire developing unit 4*a* is capable of a rocking motion by pins 48 with respect to the photosensitive member unit 50. Thus the developing unit 4*a* is formed as a structure suspended by the photosensitive member unit 50.

The developing unit 4*a* is constantly urged by a pressure spring 54 constituting urging means, in a state where the process cartridge 7*a* is left alone, in such a manner that the developing roller 40*a* is in contact with the photosensitive drum 1*a* by a rotation moment about the support shafts 49. The state where the process cartridge 7*a* is left alone means a state where the process cartridge 7*a* is not mounted in the main body B of the apparatus A. Further, the toner container 41 of the developing unit 4*a* is integrally provided with a rib 46*a*, to be contacted by separating means (to be explained later) of the main body B of the apparatus A, when the developing roller 40*a* is to be separated from the photosensitive drum 1*a*.

(Mounting/Detaching of Process Cartridge)

Figure 4A:
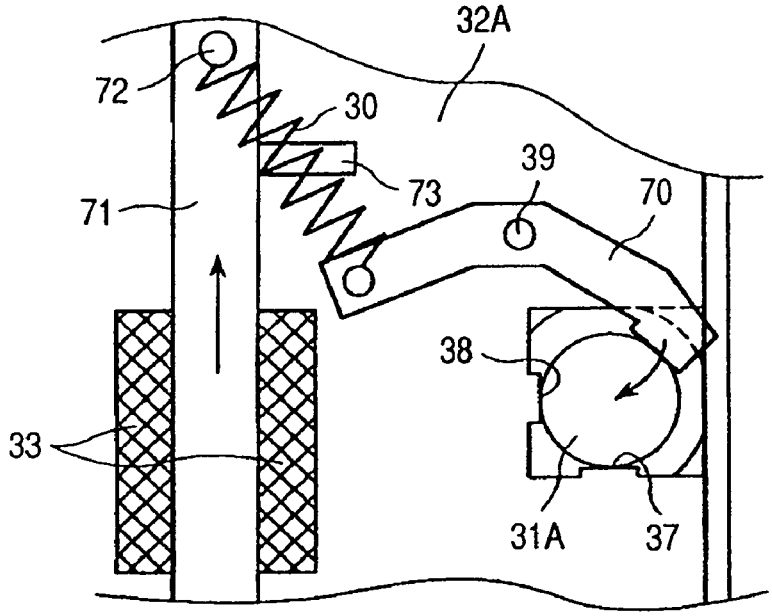
FIGS. 4A and 4B are views showing a positioning operation of the process cartridge in the main body of the apparatus.
Figure 4B:
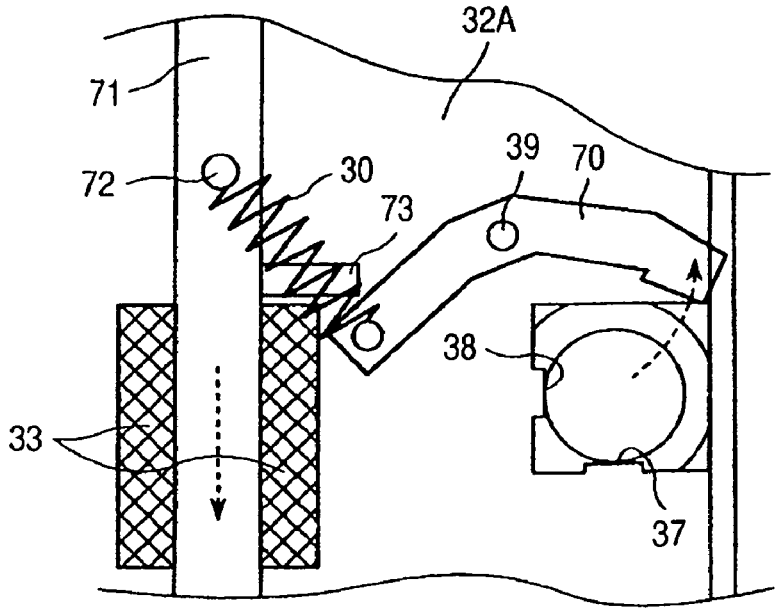
Figure 5:
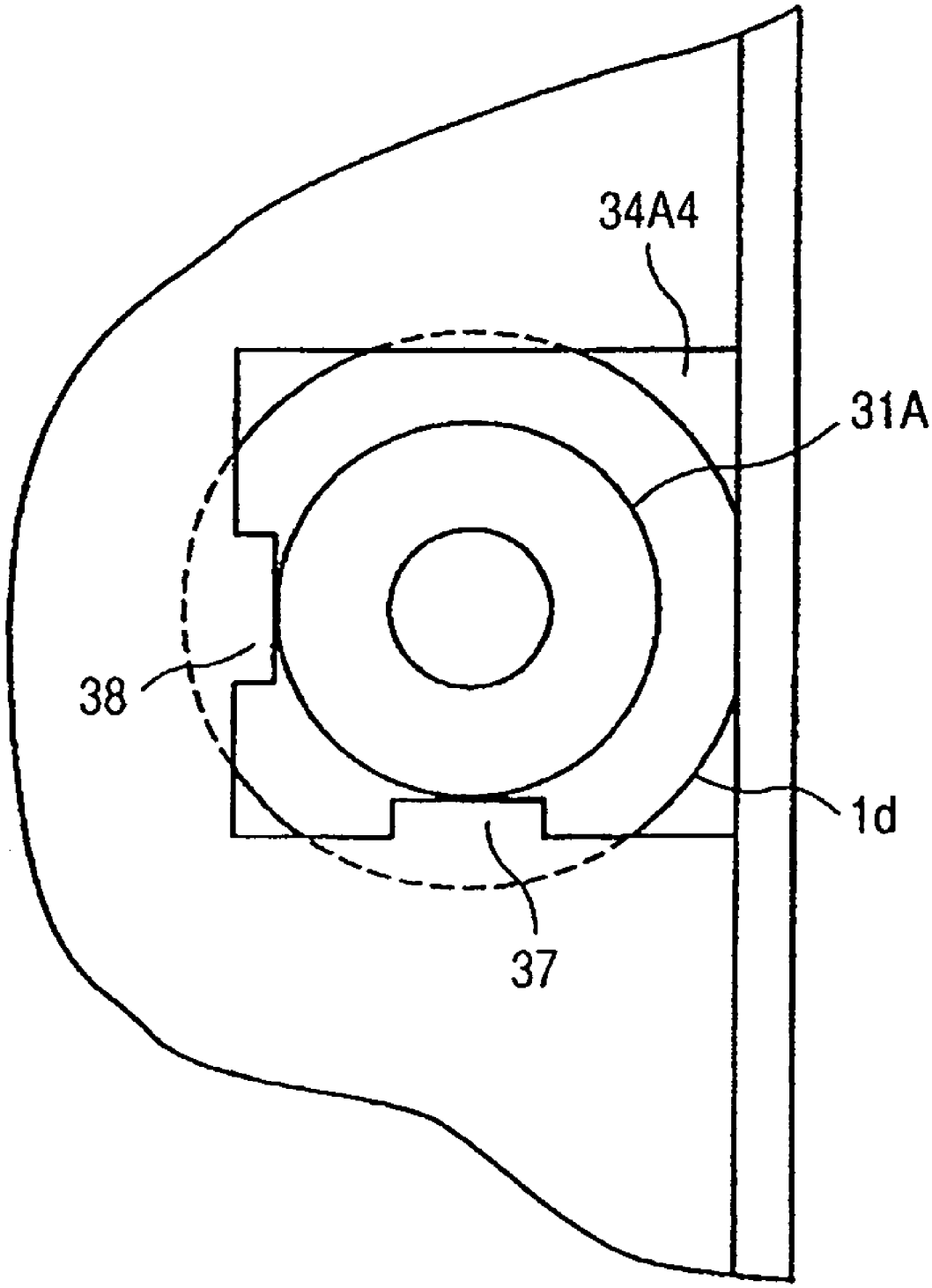
FIG. 5 is a view showing a positioning part for the process cartridge provided in the main body of the apparatus.

Now a mounting/detaching operation of a process cartridge 7*d* will be explained with reference to FIGS. 3 to 5. In FIG. 3, for the ease of understanding of the structure, the process cartridge 7*d* integrally including a photosensitive drum 1*d*, a charging roller 2*d*, a developing unit 4*d* and a cleaning device 6*d* is represented in a simplified manner by a photosensitive drum 1*d* and bearings 31A, 31B only.

As explained above, the process cartridge 7*d* in a state left alone is in a state in which the developing roller is constantly contacted with the photosensitive drum as shown in FIG. 2. The process cartridge 7*d* is mounted, as shown in FIG. 3, along guide grooves (left guide groove 34A4 and right guide groove 34B4), serving as mounting means provided in the main body B of the apparatus A. The left guide grooves 34A1, 34A2, 34A3 and right guide grooves 34B1, 34B2, 34B3 are provided respectively for the process cartridges 7*a*, 7*b* and 7*c*.

Thus, the process cartridge 7*d* is mounted in the main body B of the apparatus A, by inserting, along the guide grooves 34A4 and 34B4, the bearing (left bearing 31A and right bearing 31B) which supports the photosensitive drum 1*d* along a direction indicated by an arrow in the illustration. At such operation, the transfer belt 11 is retracted for example together with a front door C (cf. FIG. 1) of the main body B of the apparatus A, thereby opening an inserting portion for the process cartridges. Then, as shown in FIG. 5, the bearing 31A is pressed to impinging faces 37, 38, constituting positioning means in the guide groove 34A4 thereby defining the position of the process cartridge 7*d*.

In the main body B of the apparatus A, the process cartridge is pressed in the following manner. As shown in FIGS. 4A and 4B, shafts 39 are caulked respectively on the left and right side plates 32A, 32B. On the shaft 39, a pressing lever 70 serving as a pressing member is mounted rotatably. Also an end of a tension spring (torsion coil spring) 30 serving as pressure generating means is fixed on the pressing lever 70. The other end of the tension spring 30 is fixed to a fixed part 72. The fixed part 72 is provided on a rod 71. The rod 71 is movable in linkage with an opening/closing of the door C of the main body B of the apparatus A, and is movable in directions indicated by arrows of solid and broken lines in the illustrations, along a guide shape (e.g. formed by a bent part 33) provided in each of the left and right side plates 32A, 32B.

When the door C is opened, the rod 71 moves in a direction indicated by a broken-lined arrow in FIG. 4B, and an acting part 73 provided in the rod 71 moves the pressing lever 70 in a direction indicated by a broken-lined arrow (counterclockwise) therein. Thus an inserting part for the process cartridge 7*d* is opened, whereby the process cartridge 7*d* may be detached or mounted. In this state, the tension spring 30 is close to its natural length, thereby exerting almost no pressure.

Then, when the process cartridge 7*d* is inserted and the door C is closed, the rod 71 moves in a direction indicated by a solid-lined arrow in FIG. 4A, and the pressing lever 70 rotates in a direction indicated by a solid-lined arrow (clockwise) therein. Thus the tension spring 30 is pulled, whereby the bearing 31A is pressed to the impinging parts 37, 38 of the side plate 32A under a force of about 10N in the direction of the solid-lined arrow shown in the illustration.

Figure 6:
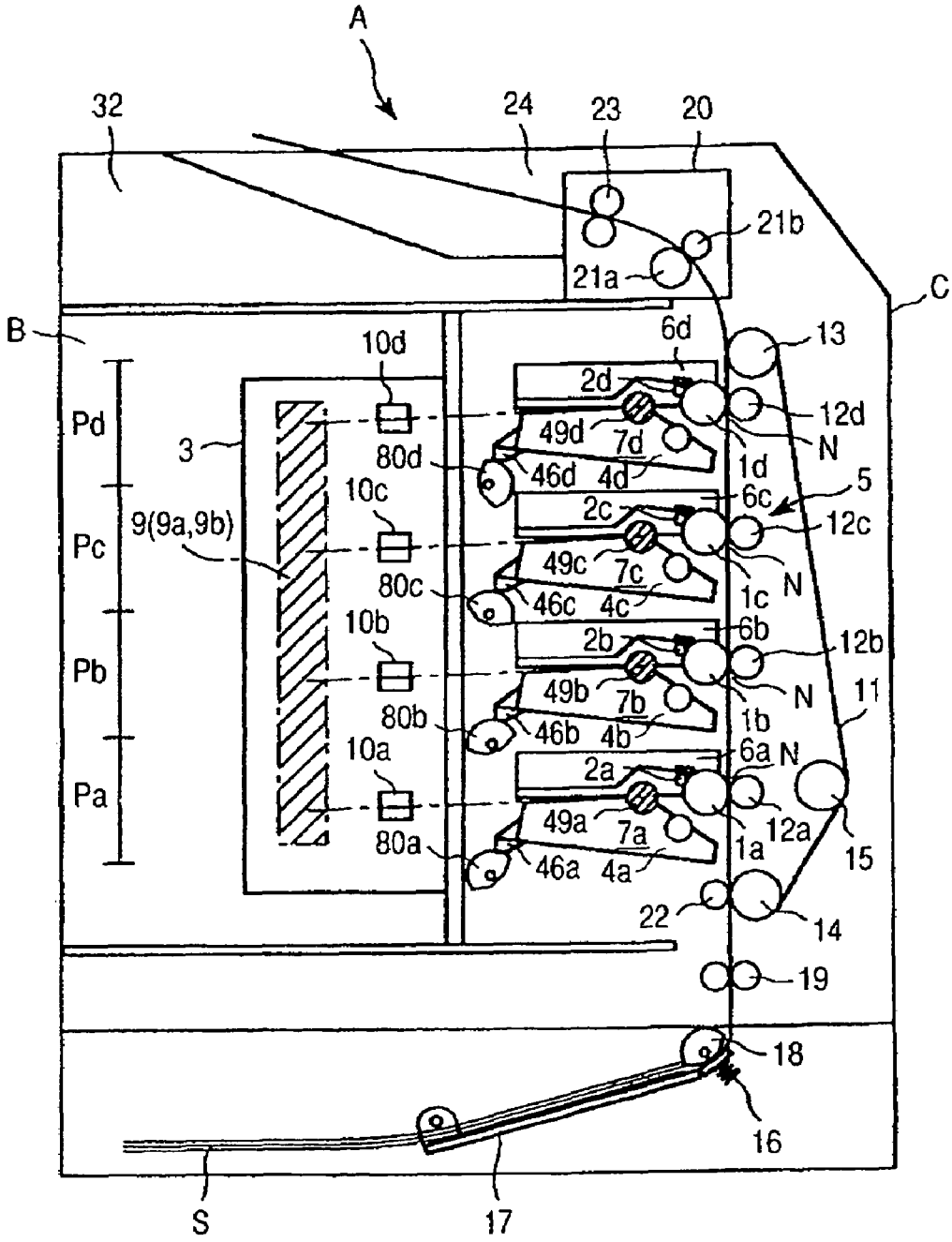
FIG. 6 is a view showing a state where, in the image forming apparatus shown in FIG. 1, developing rollers are separated from photosensitive drums.

As shown in FIGS. 1 and 6, in the main body B of the apparatus A at a rear side of the inserting direction of the process cartridges 7*a*, 7*b*, 7*c* and 7*d*, there is provided separation means which rocks the development frame member 45 against the urging forces of the pressure springs 54 of the developing units 4*a*, 4*b*, 4*c* and 4*d*, thereby separating the developing rollers 40*a*, 40*b*, 40*c* and 40*d* from the photosensitive drums 1*a*, 1*b*, 1*c* and 1*d*. The separation means is formed by separating cams 80*a*, 80*b*, 80*c* and 80*d* such as plate cams. The separating cams 80*a*, 80*b*, 80*c* and 80*d* push up the ribs 46*a*, 46*b*, 46*c* and 46*d* provided in the developing units 4*a*, 4*b*, 4*c* and 4*d* of Y, M, C and Bk colors. The separating cams 80*a*, 80*b*, 80*c* and 80*d* are provided respectively corresponding to the process cartridges 7*a*, 7*b*, 7*c* and 7*d*.

Figure 7:
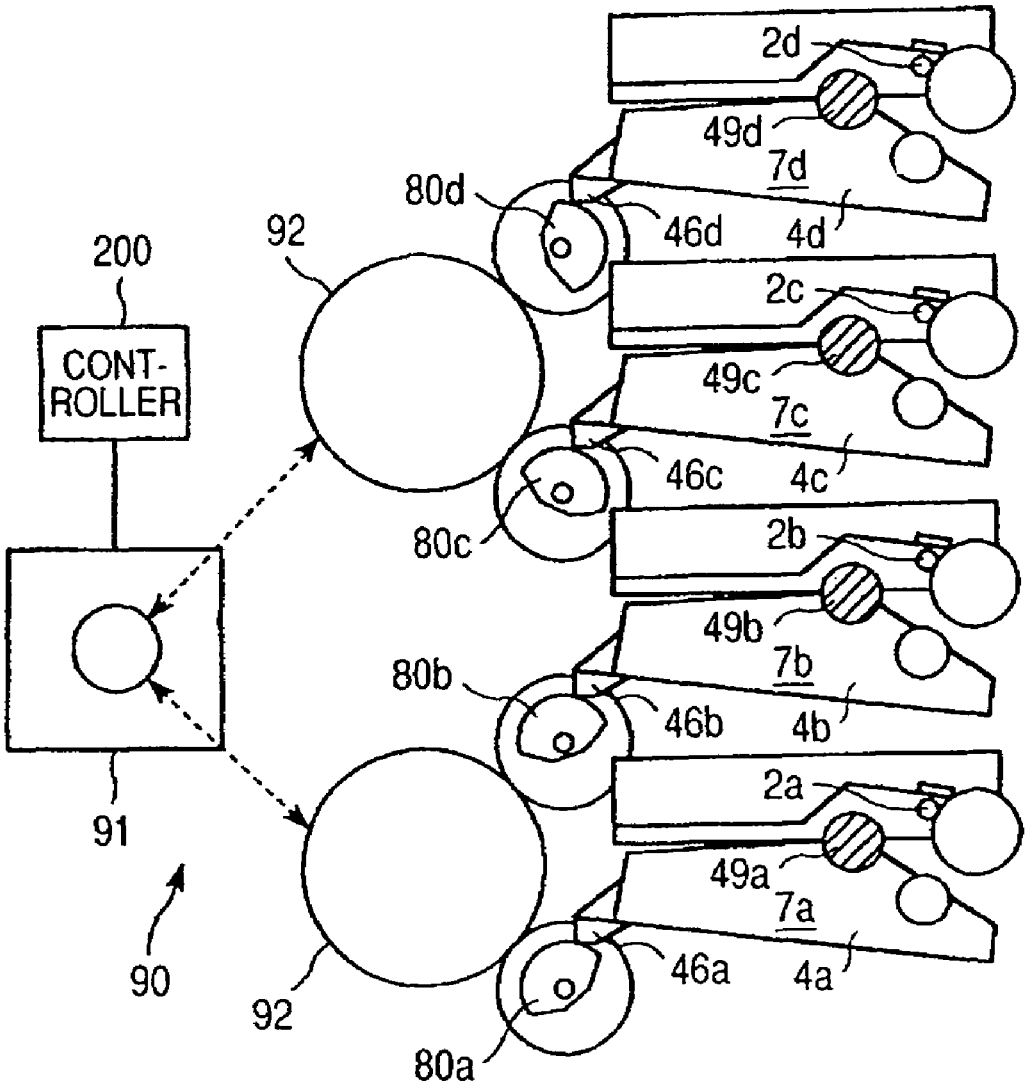
FIG. 7 is a view showing a separating cam drive apparatus.

The separating cams 80*a*, 80*b*, 80*c* and 80*d* cause the developing rollers 40*a*, 40*b*, 40*c* and 40*d* to be contacted with or separated from the photosensitive drums 1*a*, 1*b*, 1*c* and 1*d* in the following manner. In the present embodiment, as shown in FIG. 7, a separating cam drive apparatus 90, constituting drive means for the separating means, is equipped with a stepping motor 91 as a drive source for the separating means. Though not restrictive, the driving power of the single stepping motor 91 in the present embodiment is branched by a drive transmission gear train 92 provided in the separating cam drive apparatus 90 and is transmitted to all the separating cams 80*a*, 80*b*, 80*c* and 80*d*. Thus, the separating cams 80*a*, 80*b*, 80*c* and 80*d* in this embodiment can rotate at a same phase in a same direction.

The stepping motor 91 causes rotation of the separating cams 80*a*, 80*b*, 80*c* and 80*d*, and, by such rotation, the separating cams 80*a*, 80*b*, 80*c* and 80*d* cause, by means of the ribs 46*a*, 46*b*, 46*c* and 46*d*, a rocking motion in the developing units 4*a*, 4*b*, 4*c* and 4*d* of the process cartridges 7*a*, 7*b*, 7*c* and 7*d*. Thus the developing rollers 40*a*, 40*b*, 40*c* and 40*d* are contacted with or separated from the photosensitive drums 1*a*, 1*b*, 1*c* and 1*d*. Thus the positions of the developing rollers 40*a*, 40*b*, 40*c* and 40*d* with respect to the photosensitive drums 1*a*, 1*b*, 1*c* and 1*d* are switched between a contact position in contact with the photosensitive drums 1*a*, 1*b*, 1*c* and 1*d* and a separated position separated from the photosensitive drums 1*a*, 1*b*, 1*c* and 1*d*.

In the present embodiment, there can be selected three modes, which are:

(i) a standby state (standby state) in which, in the image forming parts Pa, Pb, Pc and Pd of all the Y, M, C, Bk colors, the separating cams 80*a*, 80*b*, 80*c* and 80*d* are in contact, at maximum radii thereof, with the ribs 46*a*, 46*b*, 46*c* and 46*d*, whereby all the developing rollers 40*a*, 40*b*, 40*c* and 40*d* are separated from the photosensitive drums 1*a*, 1*b*, 1*c* and 1*d;*

(ii) a full-color state (full-color mode) in which, in the image forming parts Pa, Pb, Pc and Pd of all the Y, M, C, Bk colors, the separating cams 80*a*, 80*b*, 80*c* and 80*d* assume a minimum radius position thereof and are separated from the ribs 46*a*, 46*b*, 46*c* and 46*d*, whereby all the developing rollers 40*a*, 40*b*, 40*c* and 40*d* are contacted with the photosensitive drums 1*a*, 1*b*, 1*c* and 1*d*; and (iii) a mono-color state (mono-color mode) in which, in the image forming parts Pa, Pb and Pc, the developing rollers 40*a*, 40*b* and 40*c* are separated from the photosensitive drums 1*a*, 1*b* and 1*c* and, only in the image forming part Pd for Bk color, the developing roller 40*d* is in contact with the photosensitive drum 1*d*.

In the multi-color mode, in the image forming parts Pa, Pb, Pc and Pd of Y, M, C, Bk colors, the developing rollers 40*a*, 40*b*, 40*c* and 40*d* are contacted, in succession in this order and with a certain time interval, with the photosensitive drums 1*a*, 1*b*, 1*c* and 1*d* to execute an image formation. Also similarly in the separation of the developing rollers 40*a*, 40*b*, 40*c* and 40*d* from the photosensitive drums 1*a*, 1*b*, 1*c* and 1*d*, the developing rollers 40*a*, 40*b*, 40*c* and 40*d* are separated, in succession in this order and with a certain time interval, from the photosensitive drums 1*a*, 1*b*, 1*c* and 1*d*.

The separating cam drive apparatus 90 is controlled by a controller 200 of an engine control part, which controls the entire operations of the image forming apparatus A. The controller 200 is provided with an operation part, a control part and a memory part, and executes a sequence control of the separating cam drive apparatus 90 according to a control program for the separating means, stored in the memory part.

Thus the controller 200 has a function as control means for the separating cams 80*a*, 80*b*, 80*c* and 80*d*.

(Process Cartridge Drive Apparatus)

Now there will be explained an operation mechanism, when the process cartridges 7*a*, 7*b*, 7*c* and 7*d* are mounted in the main body B of the apparatus A.

At the mounting of the process cartridges 7*a*, 7*b*, 7*c* and 7*d* in the main body B of the apparatus A, as shown in FIG. 6, all the separating cams 80*a*, 80*b*, 80*c* and 80*d* in the image forming parts Pa, Pb, Pc and Pd of 4 colors are in contact, with maximum radii thereof, with the ribs 46*a*, 46*b*, 46*c* and 46*d*. Therefore, along the inserting operations of the process cartridges 7*a*, 7*b*, 7*c* and 7*d*, the ribs 46*a*, 46*b*, 46*c* and 46*d* provided in the developing units 4*a*, 4*b*, 4*c* and 4*d* ride on the separating cams 80*a*, 80*b*, 80*c* and 80*d*, whereby the developing rollers 40*a*, 40*b*, 40*c* and 40*d* are separated from the photosensitive drums 1*a*, 1*b*, 1*c* and 1*d* by a predetermined gap. In this state, the separating cams 80*a*, 80*b*, 80*c* and 80*d* of the image forming parts Pa, Pb, Pc and Pd are in a home position illustrated in FIG. 7 and in a state (b) in FIG. 8, and push up the ribs 46*a*, 46*b*, 46*c* and 46*d* in all the image forming parts Pa, Pb, Pc and Pd.

Such separated state is maintained always while the power supply is turned off and while the developing operation is not conducted. Therefore, while the process cartridges 7*a*, 7*b*, 7*c* and 7*d* are mounted but not used for a prolonged period, the developing rollers 40*a*, 40*b*, 40*c* and 40*d* are always separated from the photosensitive drums 1*a*, 1*b*, 1*c* and 1*d*. It is thus possible to securely prevent a permanent deformation of the roller layers, resulting from a prolonged contact of the developing rollers 40*a*, 40*b*, 40*c* and 40*d* with the photosensitive drums 1*a*, 1*b*, 1*c* and 1*d*.

In the following description, there will be explained a drive structure for the photosensitive drums 1*a*, 1*b*, 1*c* and 1*d* and the developing rollers 40*a*, 40*b*, 40*c* and 40*d*, and operations thereof in each of the multi-color mode and the mono-color mode.

As explained above, the "4-motor system" involves drawbacks of a possibly higher cost, an increased weight of the apparatus and a possibly larger space occupied by the drive apparatus. Also the "1-motor system" involves a drawback resulting from an uneven rotation of the photosensitive member caused by a meshing in the clutch.

Figure 20:
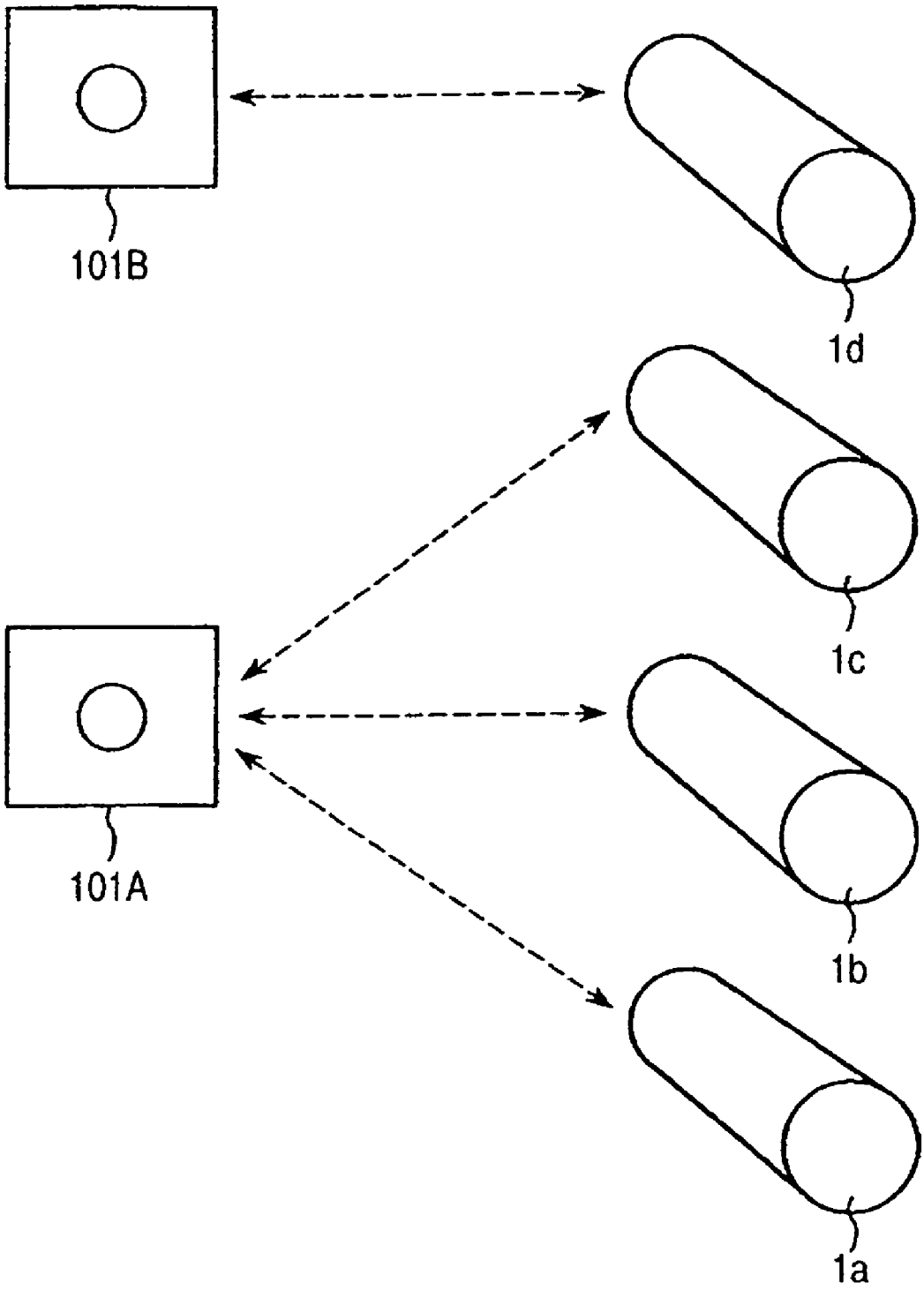
FIG. 20 is a conceptual view showing a drive structure for process cartridges in a 2-motor system.

Therefore the present embodiment adopts a "2-motor system", as illustrated in a conceptual view in FIG. 20. More specifically, three photosensitive drums 1*a*, 1*b* and 1*c* for Y, M and C colors are driven, through gears, belts or rollers, by a single motor 101A, and the remaining photosensitive drum 1*d* for Bk color is driven by another motor 101B.

In the case of such a "2-motor system", in the Bk monocolor mode, the photosensitive drum 1*d* for Bk is driven while the drive power transmission to other photosensitive drums 1*a*, 1*b* and 1*c* can be terminated by stopping the rotation of the motor itself, whereby a clutch part may be dispensed with. It is therefore possible to avoid drawbacks such as an aggravation in a color misalignment or a banding phenomenon, resulting from a rotation unevenness in the photosensitive drums and caused by an accumulated eccentricity of the meshing error in the clutch part or of the precision of constituent parts.

In the "2-motor system", under a condition of a constant drive gear ratio, the load torque ratio becomes 3:1, thus resulting in a large difference in the loads. However, such unbalance in the load torques can be resolved by optimizing the torque distribution, in consideration not only of the photosensitive drums but also the developing rollers to which the drive power is transmitted from a same drive source. It is therefore rendered possible to utilize two same motors. It is therefore possible to avoid a mistake of erroneously mounting a different motor at the assembling operation, and an advantage in cost can be realized. This system will be explained below in more details.

Figure 11:
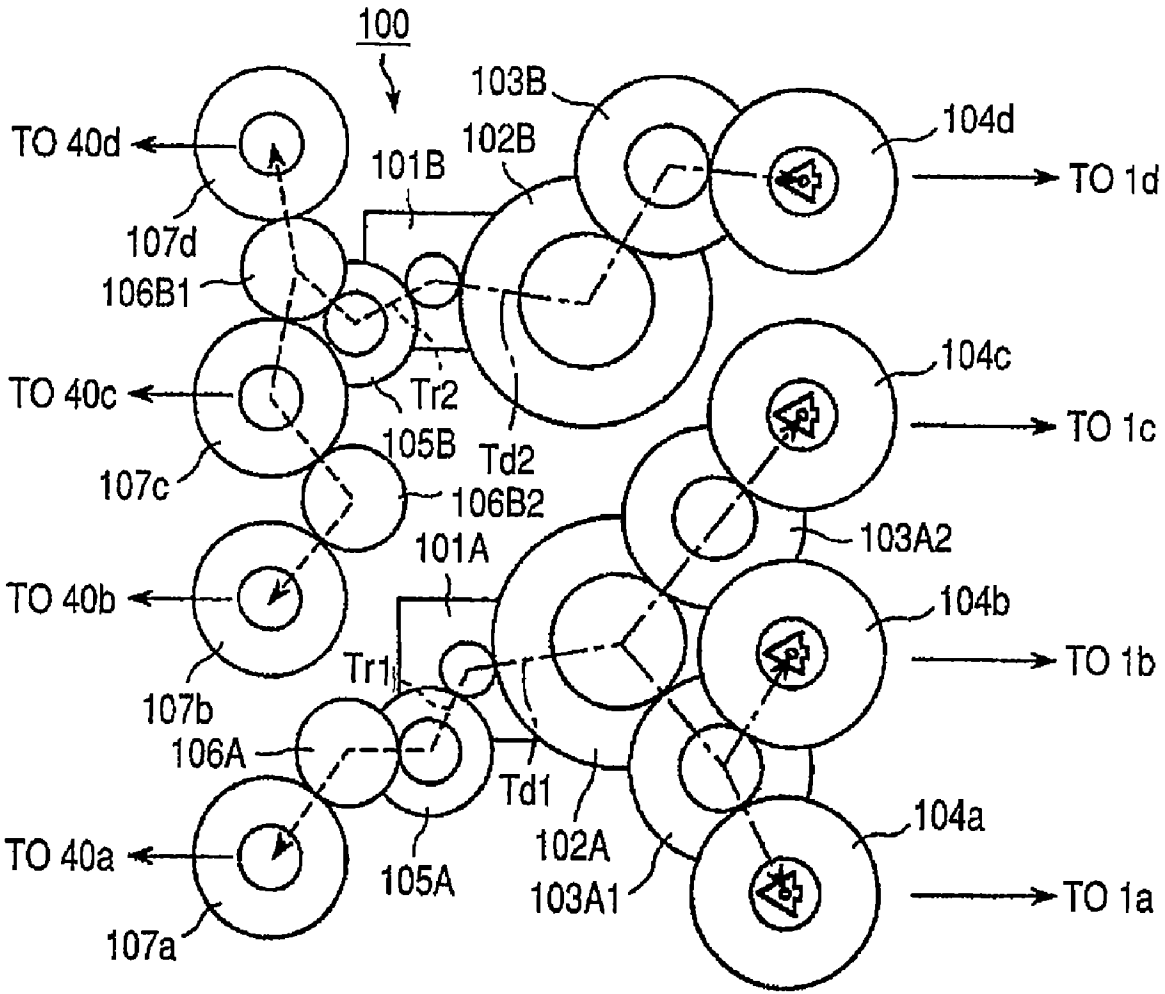
FIG. 11 is a view showing a drive system for photosensitive drums and developing rollers.

At first, an outline of the entire drive system is shown in FIG. 11.

In the present embodiment, as shown in FIG. 11, a process cartridge drive apparatus (hereinafter simply referred to as "drive apparatus") 100 includes a first motor 101A constituting a first drive device, and a second motor 101B constituting a second drive device. The drive apparatus 100 is drive means which drives 4 process cartridges 7*a*, 7*b*, 7*c* and 7*d*, more specifically at least 4 photosensitive drums 1*a*, 1*b*, 1*c* and 1*d* and the developing rollers 40*a*, 40*b*, 40*c* and 40*d* provided respectively in the 4 process cartridges 7*a*, 7*b*, 7*c* and 7*d*.

The first motor 101A drives, along a first photosensitive drum driving train (hereinafter referred to as "drum drive train") Td1, a first idler gear 102A in a succeeding stage to the first motor 101A, first and second precedent-stage gears 103A1 and 103A2, and photosensitive drum driving gears (hereinafter called "drum drive gears") 104*a*, 104*b* and 104*c*. It thus rotates the photosensitive drums 1*a*, 1*b* and 1*c*, respectively provided in the process cartridges 7*a*, 7*b* and 7*c* for the images of Y, M and C colors.

At the same time, the first motor 101A is connected, along a first developing roller drive train Tr1 and across 2 idler gears, to a clutch gear 107*a* corresponding to the image forming part Pa for forming a yellow image. The 2 idler gears are a first-stage idler gear 105A and a second-stage idler gear 106A. Finally it meshes with an input gear for the process cartridge 7*a* for Y color image, thereby driving the developing roller 40*a*.

The second motor 101B drives, like the first motor 101A, along a second drum drive train Td2, a second idler gear 102B in a succeeding stage to the second motor 101*b*, a third precedent-stage gear 103B and a fourth drum drive gear 104*d*. It thus rotates the photosensitive drum 1*d*, provided in the process cartridge 7*d* for the Bk image.

At the same time, the second motor 101B is connected, as in the first motor 101A, along a second developing roller drive train Tr2 and across 3 idler gears, to second, third and fourth clutch gears 107*b*, 107*c*, 107*d*. The 3 idler gears are a first-stage idler gear 105B, a second-stage idler gear 106B1 and a third-stage idler gear 106B2. Also the second, third and fourth clutch gears 107*b*, 107*c*, 107*d* correspond to the image forming parts Pb, Pc and Pd for forming the images of M, C and Bk colors. Finally it meshes with input gears for the process cartridges 7*b*, 7*c* and 7*d* for M, C and Bk images, thereby driving the developing rollers 40*b*, 40*c* and 40*d*.

Thus, among the plurality of image bearing members, plural first image bearing members 1*a*, 1*b* and 1*c* execute toner image formation in a first mode (multi-color mode) but do not execute toner image formation in a second mode (mono-color mode), while the second image bearing member 1*d*, different from the plural first image bearing members 1*a*, 1*b* and 1*c* among the plurality of image bearing members, executes toner image formation both in the first mode and in the second mode. In other words, in a first mode, the toner image is formed on each of said plural first image bearing members and said second image bearing member, and in a second mode, the toner image is not formed on said plural first image bearing members and the toner image is formed on said second image bearing member. The first drive device 101A drives the plural first image bearing members 1*a*, 1*b* and 1*c*, while the second drive device 101B drives the second image bearing member 1*d*, the developing roller or driven member

40*d* acting on the second image bearing member 1*d* and at least a driven member acting on the plural first image bearing members 1*a*, 1*b* and 1*c*. The driven member is a member to be driven by a driving source.

Also in the present embodiment, the first drive device 101A drives at least a driven member, acting on the plural first image bearing members 1*a*, 1*b* and 1*c*.

In the present embodiment, the first drive device 101A and the second drive device 101B have objects of a same number, to which the driving power is supplied.

Thus, in the present embodiment, the drive apparatus 100 is equipped with 2 motors, i.e. the first motor 101A and the second motor 101B, for driving the photosensitive drums 1*a*, 1*b*, 1*c* and 1*d* of the image forming parts Pa, Pb, Pc and Pd. In particular in the present embodiment, each of the 2 motors 101A, 101B bears the loads of 4 rollers, in order to optimize the torque distribution.

In the following description, the function of the drive apparatus 100 in an image output operation will be explained in a multi-color mode and in a mono-color mode.

(Multi-Color Mode)

In the multi-color mode, as explained above, a full-color image can be obtained by forming images of Y, M, C and Bk colors in the image forming parts Pa, Pb, Pc and Pd.

In the multi-color mode, when an image output operation is initiated by a print signal, the 2 motors 101A, 101B for driving the process cartridges 7*a*, 7*b*, 7*c* and 7*d* and the drive motor for the transfer belt 11 are activated. In this state, in the first and second developing roller drive trains Tr1, Tr2, all the clutches, namely the clutch gears 107*a*, 107*b*, 107*c* and 107*d* are disconnected, so that all the developing rollers 40*a*, 40*b*, 40*c* and 40*d* do not rotate.

Figure 8:
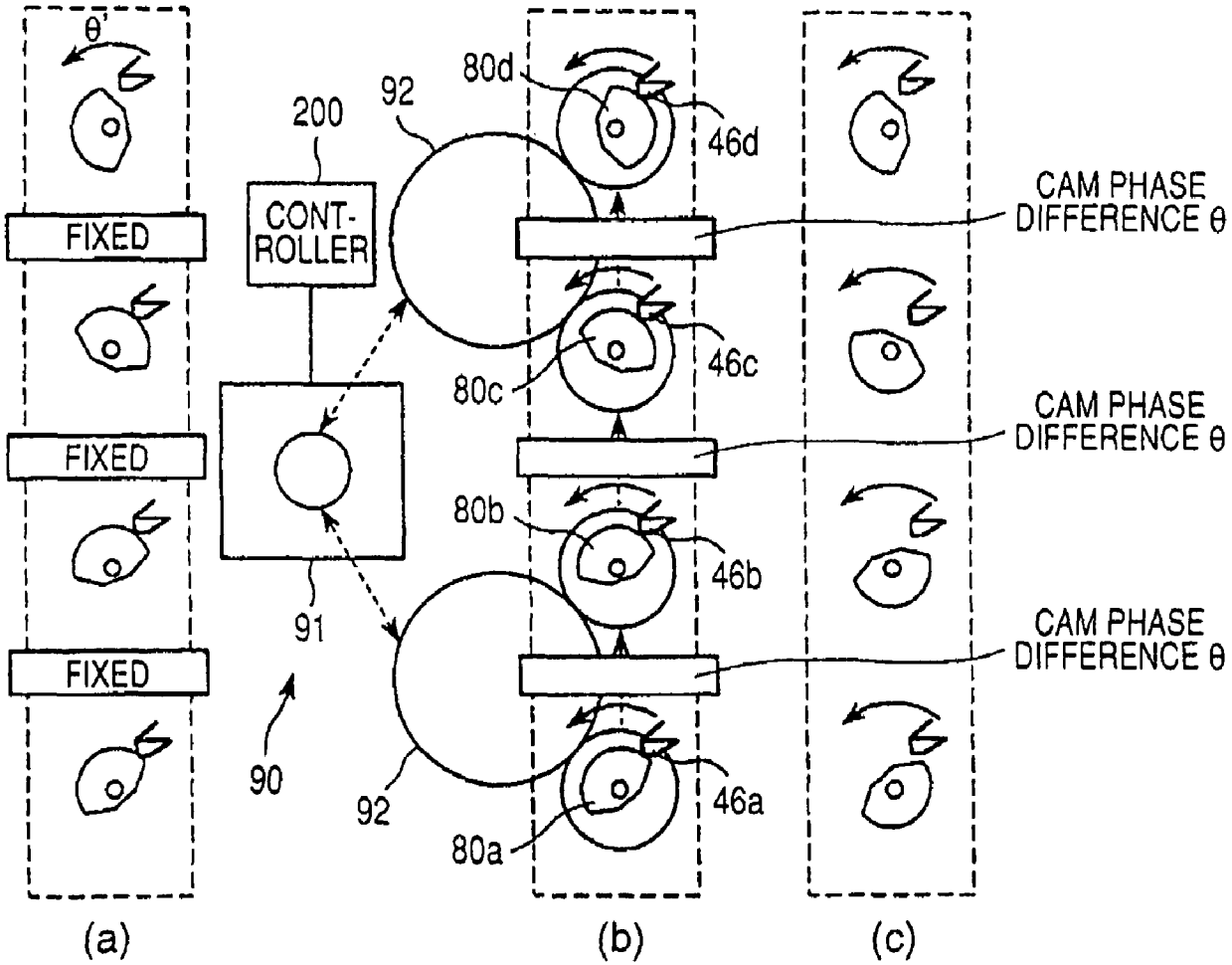
FIG. 8 is a view showing movements of the separating cams.

Then, when the stepping motor 91 of the separating cam drive apparatus 90 is rotated, as shown in FIG. 8, the separating cams 80*a*, 80*b*, 80*c* and 80*d* start to rotate counterclockwise from a home position shown in a state (b) in FIG. 8. In this operation, the clutch gear 107*a*, provided in the first developing roller drive train Tr1 is turned on whereby the developing roller 40*a* starts to rotate. Then, immediately thereafter, by the rotation of the stepping motor 91 by a predetermined amount to rotate all the separating cams 80*a*, 80*b*, 80*c* and 80*d* counterclockwise by a predetermined amount (corresponding to a phase θ), whereby the rib 46*a* of the process cartridge 7*a* is released from being pushed up by the separating cam 80*a*. Thus the development frame member 45 of the process cartridge 7*a* is rendered capable of a rocking motion by the urging force of the pressure spring 54, whereby the developing roller 40*a* is brought into contact with the photosensitive drum 1*a* to start an image formation.

Similarly the second, third and fourth clutch gears 107*b*, 107*c*, 107*d* are turned on in succession, whereby the developing rollers 40*b*, 40*c*, 40*d* are contacted in succession with predetermined time intervals (corresponding to a time required by the separating cam 80*a*, 80*b*, 80*c* or 80*d* to rotate by a cam phase difference θ shown in FIG. 8).

Thus, as shown in a state (c) in FIG. 8, the ribs 46*a*, 46*b*, 46*c* and 46*d* of all the process cartridges 7*a*, 7*b*, 7*c* and 7*d* are released from the pushed-up state by the separating cams 80*a*, 80*b*, 80*c* and 80*d*. Therefore in all the process cartridges 7*a*, 7*b*, 7*c* and 7*d*, the developing rollers 40*a*, 40*b*, 40*c* and 40*d* are contacted with the photosensitive drums 1*a*, 1*b*, 1*c* and 1*d* to enable the image formation in the multi-color mode.

Figure 9:
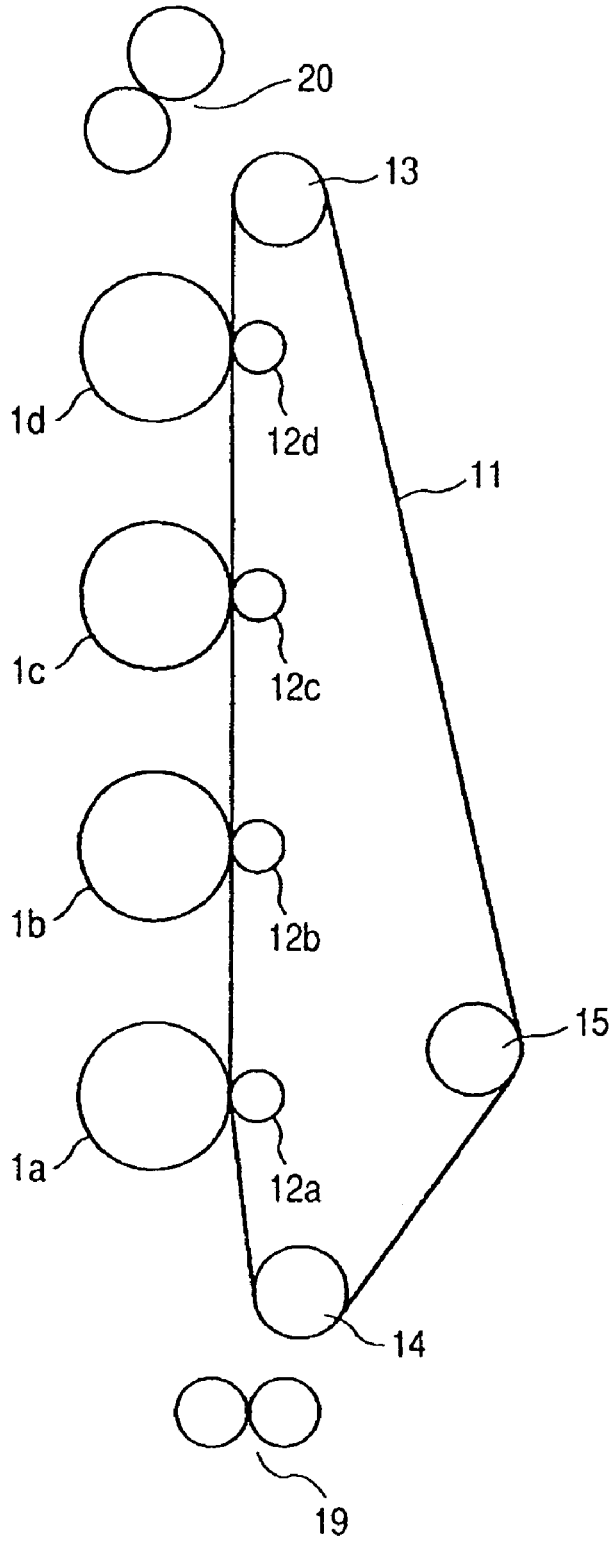
FIG. 9 is a view showing a contact state between a transfer belt and photosensitive drums in a multi-color mode.

In this state, as shown in FIG. 9, in all the image forming parts Pa, Pb, Pc and Pd, the photosensitive drums 1*a*, 1*b*, 1*c* and 1*d* are in contact, across the transfer belt 11, with the transfer rollers 12*a*, 12*b*, 12*c* and 12*d*.

After the completion of image formation in the image forming part Pa, the stepping motor 91 rotates further, whereby the separating cams 80*a*, 80*b*, 80*c* and 80*d* further rotate counterclockwise from the state (c) shown in FIG. 8. Then, at first in the image forming part Pa, the separating cam 80*a* pushes up the rib 46*a* against the urging force of the pressure spring 54 of the process cartridge 7*a*, to cause a rocking motion of the developing development frame member 45, thereby separating the developing roller 40*a* from the photosensitive drum 1*a*. In succession, the clutch gear 107*a* is turned off, thereby terminating the rotation of the developing roller 40*a*. Thereafter, in a similar manner as in the contacting state, the developing rollers 40*b*, 40*c*, 40*d* are separated from the photosensitive drums 1*b*, 1*c*, 1*d* in succession with predetermined time intervals (corresponding to a time required by the separating cam 80 to rotate by a cam phase difference θ). Also the clutch gears 107*b*, 107*c* and 107*d* are turned off in succession. Thus a state (b) shown in FIG. 8 is reached, whereupon the image output in the multi-color mode is terminated.

In the present embodiment, after the developing rollers 40*a*, 40*b*, 40*c* and 40*d* are separated from the photosensitive drums 1*a*, 1*b*, 1*c* and 1*d* in all the image forming parts Pa, Pb, Pc and Pd, the rotation of the first motor 101A and the second motor 101B for driving the process cartridges 7*a*, 7*b*, 7*c* and 7*d* and of the drive motor for the transfer belt 11 is terminated.

(Mono-Color Mode)

In the mono-color mode, when an image output operation is initiated by a print signal, the second motor 101B for driving the process cartridge 7*d* and the drive motor for the transfer belt 11 are activated. In this state, in the second developing roller drive train Tr2, all the clutches, namely the clutch gears 107*b*, 107*c* and 107*d* are disconnected, so that the developing rollers 40*b*, 40*c* and 40*d* do not rotate. Also in the present embodiment, the first motor 101A is stopped, and the gear clutch 107*a* in the first developing roller drive train Tr1 is disconnected, so that the developing roller 40*a* does not rotate.

Then, as in the transition from the state (b) to (c) in FIG. 8 in the multi-color mode, the stepping motor 91 of the separating cam drive apparatus 90 rotates. In the mono-color mode, as shown in FIG. 8, the separating cam 80*d* alone rotates counterclockwise by θ'. In the present embodiment, among the drive trains involved in the contact and separation of the developing rollers 40*a*, 40*b*, 40*c* and 40*d* with the photosensitive drums 1*a*, 1*b*, 1*c* and 1*d*, the drive trains for the separating cams 80*a*, 80*b* and 80*c* corresponding to the image forming parts Pa, Pb and Pc are provided with clutches. In the mono-color mode, such clutches are turned off whereby the separating cam 80*d* alone may be rotated. Thus, the developing roller 40*d* alone may be contacted with the photosensitive drum 1*d* to achieve an image output in the mono-color mode, without the developing rollers 40*a*, 40*b* and 40*c* being contacted with the photosensitive drums 1*a*, 1*b* and 1*c*.

After the separating cam 80*d* starts to rotate, the clutch gear 107*d* provided in the second developing roller drive train Tr2 is turned on to rotate the developing roller 40*d*. Immediately thereafter, the stepping motor 91 rotates by a predetermined amount to rotate the separating cam 80*d* counterclockwise by a predetermined amount (corresponding to a phase θ'), whereby the rib 46*d* of the process cartridge 7*d* being released from being pushed up by the separating cam 80*d*. Thus, the development frame member 45 of the process cartridge 7*d* executes a rocking motion by the urging power of the pressure spring 54, whereby the developing roller 40*d* and the photosensitive drum 1*d* are contacted to initiate the image formation.

Figure 10:
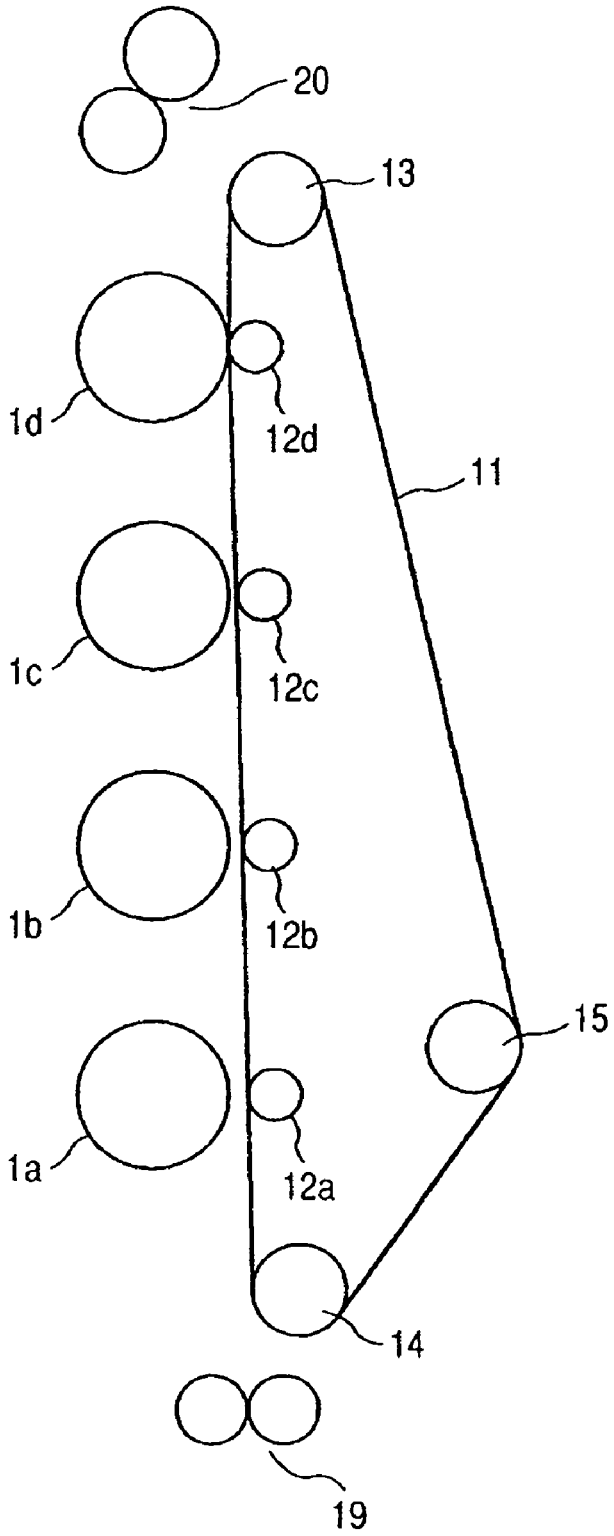
FIG. 10 is a view showing a contact/separation state between the transfer belt and the photosensitive drums in a mono-color mode.

In this state, as shown in FIG. 10, the photosensitive drums 1*a*, 1*b* and 1*c*, other than that in the image forming part of a color used in the mono-color mode, namely other than in the image forming part Pd in the present embodiment, are separated from the transfer belt 11 by moving means such as a cam mechanism or a link mechanism. More specifically, the moving means retracts the transfer rollers 12*a*, 12*b* and 12*c* from the photosensitive drums 1*a*, 1*b* and 1*c* thereby separating the transfer belt 11 from the photosensitive drum 1*a*, 1*b* and 1*c*. In this manner, in the image forming parts Pa, Pb and Pc not used in the mono-color mode, it is possible to prevent a waste in the service life of the photosensitive drums 1*a*, 1*b* and 1*c* and of the transfer belt 11. As a result, a high-quality image output can be maintained until the end of the service life of the product.

After the completion of the mono-color mode, the stepping motor 91 rotates further to rotate the separating cam 80*d* counterclockwise to a position separated from the rib 46*d* of the process cartridge 7*d*. Thus, in all the image forming parts Pa, Pb, Pc and Pd of 4 colors, the developing rollers 40*a*, 40*b*, 40*c* and 40*d* assume a state separated from the photosensitive drums 1*a*, 1*b*, 1*c* and 1*d*. Subsequently the clutch gear 107*d* is turned off to terminate the rotation of the developing roller 40*d*. Thus the image output in the mono-color mode is terminated.

In the present embodiment, after the developing roller 40*d* is separated from the photosensitive drum 1*d* in the image forming part Pd, the rotation of the second motor 101B for driving the process cartridge 7*d* and of the drive motor for the transfer belt 11 is terminated.

Thus the "2-motor system" allows to adapt to the mono-color mode, when it is necessary to stop the photosensitive drums 1*a*, 1*b* and 1*c* therein, by simply stopping the first motor 101A. Even when the first motor 101A is stopped, the second motor 101B still functions to drive the photosensitive drum 1*d* and the developing roller 40*d*, thereby enabling the image formation in the mono-color mode.

Thus, in the present embodiment, the image forming apparatus A has a first mode (multi-color mode) and a second mode (mono-color mode), which are different in the number of image forming parts used for image formation, among the plurality of image forming parts Pa, Pb, Pc and Pd. Also the plurality of image forming parts Pa, Pb, Pc and Pd include a second image forming part Pd which forms an image in both the first mode and the second mode, and plural first image forming parts Pa, Pb and Pc which form images in the first mode but do not form images in the second mode. In the present embodiment, the second image forming part is an image forming part for Bk color, while the plural first image forming parts are image forming parts for Y, M and C colors. Also the image forming apparatus A includes a first drive source (first motor) 101A, and a second drive source (second motor) 101B. The first drive source supplies the photosensitive drums 1*a*, 1*b* and 1*c* of the image forming parts Pa, Pb and Pc for Y, M and C, with a driving power. The second drive source supplies the photosensitive drum 1*d* of the image forming part Pd for Bk color and the developing roller 40*d*, with a driving power.

The second drive source 101B may further supply at least one developing roller (developing rollers 40*b*, 40*c* and 40*d* in the present embodiment) in the image forming parts Pa, Pb and Pc for Y, M and C colors, with the driving power. Also the first drive source 101A may further supply at least one developing roller (developing roller 40a in the present embodiment) in the image forming parts Pa, Pb and Pc for Y, M and C colors, with the driving power. Preferably the first drive source 101A and the second drive source 101B respectively have a same number of objects of supply of drive power.

In this manner, it is unnecessary, in the mono-color mode, to rotate the first motor 101A which serves to drive the process cartridges 7*a*, 7*b* and 7*c* for Y, M and C colors. It is therefore possible to reduce the operating noises in the mono-color mode printing, thus providing an advantage in consideration of noise standards as represented by "Blue Angel". Also a power saving is possible in the electric power consumption of the main body B of the apparatus A.

Also a clutch mechanism is provided in a drive train, which transmits the drive power to at least one developing roller (all in the present embodiment), among the developing rollers of the plurality of image forming parts provided in the image forming apparatus A. Therefore, in such an image forming part, the developing roller may be driven at a timing different from the drive timing of the photosensitive drum. It is thus possible to elongate the service life of the developing roller, by driving the developing roller according to the contact/separation timings of the developing roller to/from the photosensitive drum.

Even in the image output in the mono-color mode, in case of employing a transfer material S of a high basis weight, the contact between the photosensitive drum in the single image forming part and the transfer belt 11 may be unable to provide a sufficient conveying power for the transfer material S depending on the temperature/humidity conditions, thereby resulting in a deteriorated precision of the image output. The transfer material S of a high basis weight means a cardboard or a small-sized paper such as a postcard.

However, a sufficient conveying power for the transfer material S can be secured, also in the mono-color mode, by contacting the photosensitive drum and the transfer belt 11 not only in one image forming part Pd but in a plurality of image forming parts. In such case, in order to prevent a frictional contact between the photosensitive drum and the transfer belt 11, the photosensitive drums to be contacted with the transfer belt 11 are rotated. In the present embodiment, because of the presence of the aforementioned clutch mechanisms (clutch gears 107*a*, 107*b*, 107*c*) for the developing rollers, the rotation of the first motor 101A does not necessarily rotate the developing roller 40*a* in synchronization. It is therefore possible, in the case of contacting a plurality of photosensitive drums with the transfer belt 11 in the mono-color mode, to avoid a waste of the service life of the developing roller.

Also in the "2-motor system", a following structure, different from the present embodiment, is conceivable in consideration of the load balance in driving the photosensitive drums. More specifically it is conceivable that the first motor 101A drives the photosensitive drums 1*a* and 1*b* for Y and M colors and the second motor 101B drives the photosensitive drums 1*c* and 1*d* for C and Bk colors. In such case, it is necessary, in order to interrupt the transmission of drive power to the photosensitive drum 1*c* in the Bk mono-color mode, to provide a clutch mechanism between the second motor 101B and the drum drive gear 104*c*.

However, such clutch mechanism, when present, increases for example an eccentricity because of its structure, thereby increasing a variation in the rotation speed in the clutch output. As a result, drawbacks such as an aggravation in a color misalignment or a banding phenomenon may be encountered as in the "1-motor system" in which four photosensitive drums 1*a*, 1*b*, 1*c* and 1*d* are driven by a single motor. Also when the precision of components is improved excessively in order to avoid these drawbacks, a problem in cost may be arise. Therefore, the "2-motor system" of the present embodiment is superior to a structure in which 4 photosensitive drums are divided into 2 and 2.

In the "2-motor system" of the present embodiment, the first motor 101A drives the photosensitive drums 1*a*, 1*b* and 1*c* for 3 colors of Y, M and C, while the second motor 101B drives the photosensitive drum 1*d* for Bk color, and the second motor 101B also drives developing rollers for colors different from Bk. As the drive sources have approximately equalized loads, it is rendered possible to achieve a simpler structure and a lower cost by the use of same drive sources and an optimized load balance for the drive sources.

The drive apparatus 100 is controlled by the controller 200 of the engine control part, which controls the entire operations of the image forming apparatus A. As described above, the controller 200 is provided with an operation part, a control part and a memory part, and executes a sequence control of the drive apparatus 100 according to a control program for the drive apparatus 100, stored in the memory part. Thus the controller 200 has a function as control means for the drive apparatus 100. The controller 200 is capable of independently controlling the drive of the first motor 101A and of the second motor 101B.

(Gear Structure in Drum Drive Train)

In the following description, detailed structures of the first and second drum drive trains Td1, Td2 will be explained.

In the first drum drive train Td1 in the present embodiment, a gear (motor gear) provided on the drive shaft of the first motor 101A meshes with a larger-diameter gear of a first idler gear 102A. A smaller-diameter gear of the first idler gear 102A meshes with larger-diameter gears of first and second precedent-stage gears 103A1, 103A2. Then a smaller-diameter gear of the first precedent-stage gear 103A1 meshes with drum drive gears 104*a*, 104*b*, and a smaller-diameter gear of the second precedent-stage gear 103A2 meshes with a drum drive gear 104*c*.

On the other hand, in the second drum drive train Td2, a gear (motor gear) provided on the drive shaft of the second motor 101B meshes with a larger-diameter gear of a second idler gear 102B. A smaller-diameter gear of the second idler gear 102B meshes with a larger-diameter gear of a third precedent-stage gear 103B. Then a smaller-diameter gear of the third precedent-stage gear 103B meshes with a drum drive gear 104*d*.

In the present embodiment, the first and second drum drive trains Td1, Td2 have certain tooth number ratios among the mutually meshing gears. More specifically, from the gears (motor gears) provided on the drive shafts of the first and second motors 101A, 101B constituting the drive sources to the precedent-stage gears 103A1, 103A2 and 103B, the mutually meshing gears are connected with a tooth number ratio of 1/N1. N1 indicates a natural number and N1 may be different for each meshing. The precedent-stage gears 103A1, 103A2 and 103B respectively mesh directly with the drum drive gears 104*a*, 104*b*, 104*c* and 104*d*. The drum drive gears 104*a*, 104*b*, 104*c* and 104*d* are provided on the shafts of the photosensitive drums 1*a*, 1*b*, 1*c* and 1*d*, and rotate with same periods as the photosensitive drums 1*a*, 1*b*, 1*c* and 1*d*.

In the present embodiment, the first motor 101A and the second motor 101B have a same structure, and the first idler gear 102A and the second idler gear 102B have a same structure. Also the first to third precedent-stage gears 103A1, 103A2 and 103B, and the drum drive gears 104*a*, 104*b*, 104*c* and 104*d* respectively have a same structure. In the following description, therefore, motors or gears of a same structure will be represented by a symbol without an appendix unless a particular distinction is necessary, and will be explained collectively.

In the present embodiment, the gears in the drum drive train have the following tooth numbers:

(i) gear on the drive shaft of motor 101: 18 teeth (ii) idler gear 102, larger-diameter side: 72 teeth
smaller-diameter side: 24 teeth (iii) precedent-stage gear 103, larger-diameter side: 48 teeth Thus, the present embodiment adopts a tooth number ratio of 1/4 between (i) and (ii), and a tooth number ratio of 1/2 between (ii) and (iii).

Figure 12:
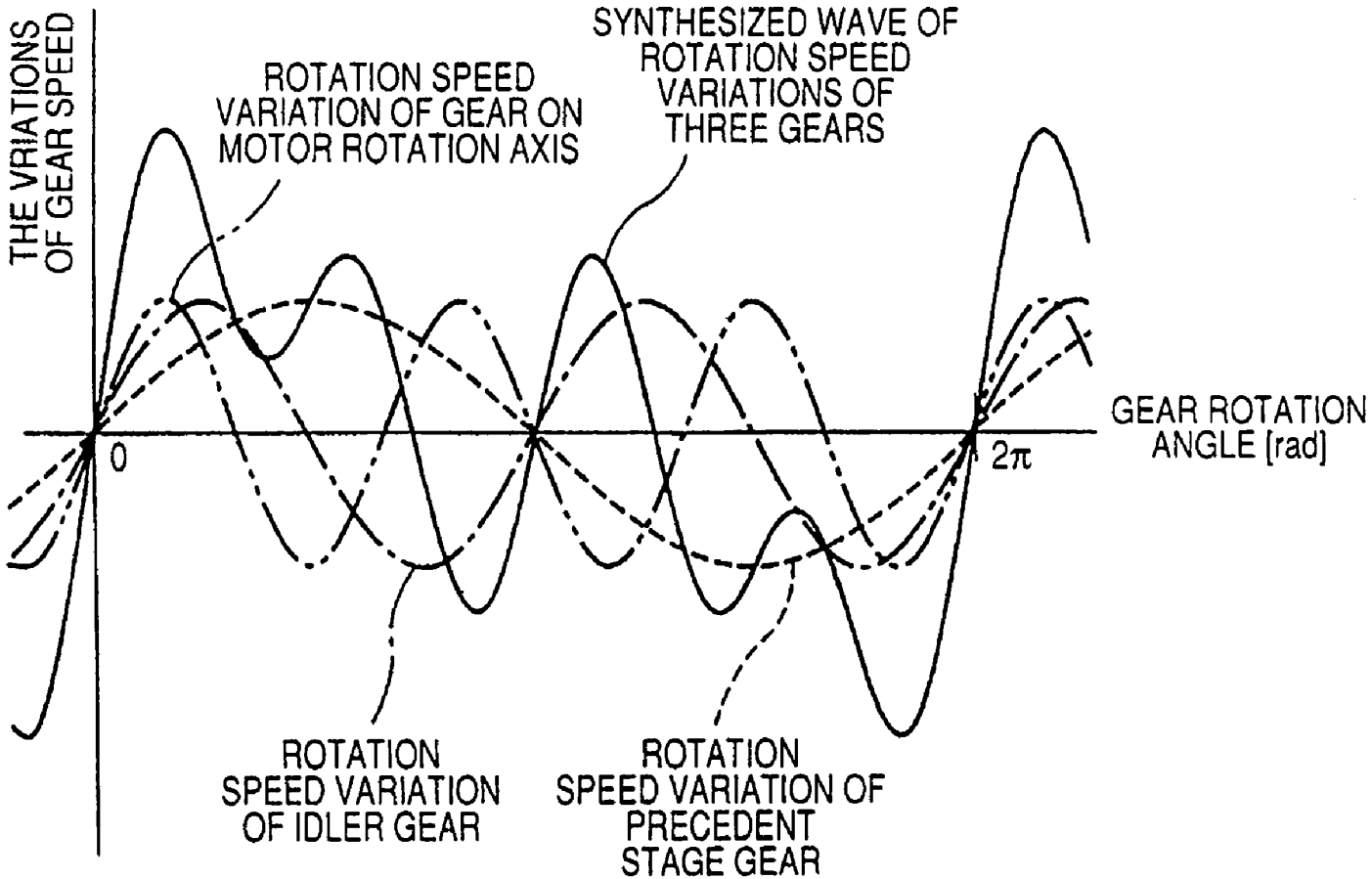
FIG. 12 is a chart for explaining a reducing ratio of a drum drive train and a peripheral speed variation of a precedent gear.

Now, for the purpose of ease of understanding, let us consider a case of a 2-stage reduction of a gear on the shaft of motor 101→an idler gear 102→a precedent-stage gear 103, with a reducing ratio of ½ between each pair of meshing gears. A speed variation in one rotation of the precedent-stage gear 103 is schematically shown in FIG. 12. A speed variation of a gear generally assumes a sinusoidal form, and this example also follows such form.

As will be apparent from a synthesized waveform shown in FIG. 12, by connecting the drive train with reducing ratios of ½, the precedent-stage gear 103 always rotates at a same speed (zero in FIG. 12) in every 1 rotation of the precedent-stage gear 103, within a period of rotational variation in such drive train. The reducing ratio is not limited to N1=2, and for a ratio 1/N1, the precedent-stage gear 103 always rotates at a same speed in every 1 rotation of the precedent-stage gear 103. Thus, regardless of a speed variation and a phase of the gears positioned upstream of the precedent-stage gear 103, these can be cancelled in the train to the precedent-stage gear 103.

Figure 13A:
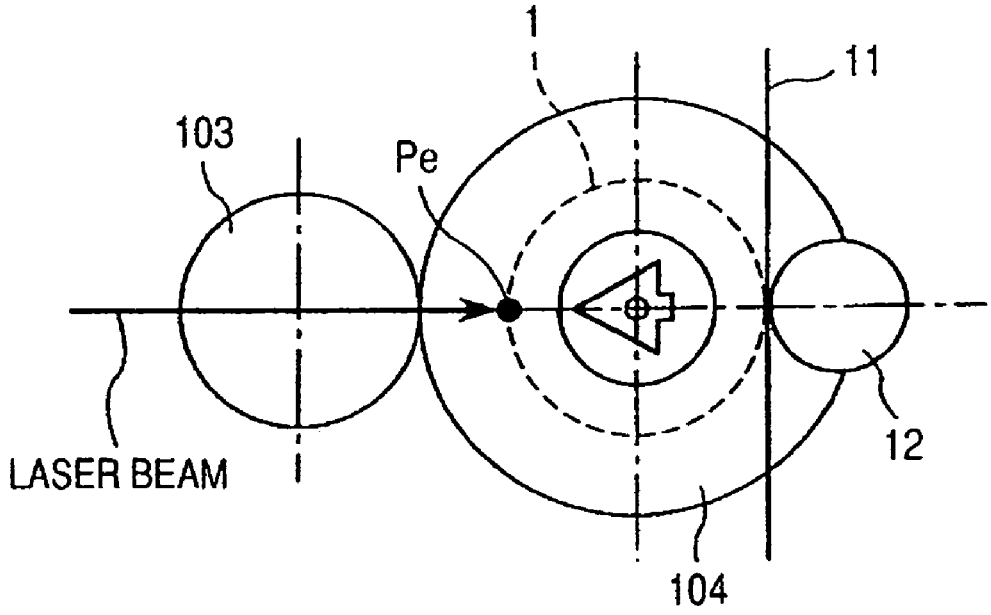
FIGS. 13A and 13B are views showing a relationship between a drum driving gear and a precedent gear at an exposure point and a transfer point.
Figure 13B:
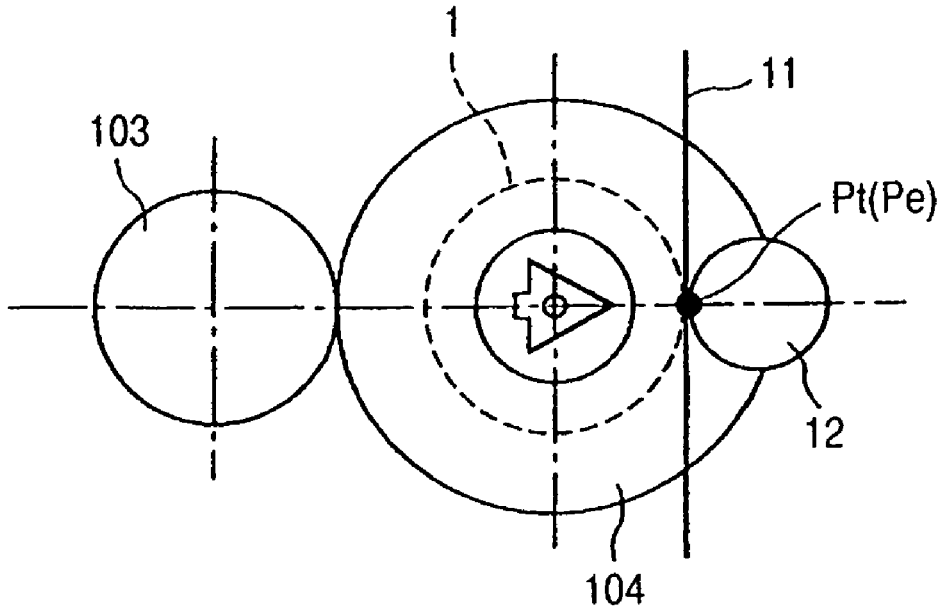

Also as shown in FIGS. 13A and 13B, a position in the periphery of the photosensitive drum 1, where an optical image is irradiated by the scanner unit 3 is defined as an exposure point Pe, and a position in the periphery of the photosensitive drum 1, where a toner image is transferred from the photosensitive drum 1 onto the transfer material S is defined as a transfer point Pt. When an angle between the exposure point Pe and the transfer point Pt (an angle formed in the rotating direction of the photosensitive drum 1) is 360/N2[°] (N2 being a natural number) with respect to the rotary center of the photosensitive drum 1, and, for a tooth number Z2 of the drum drive gear 104 and a tooth number Z1 of the precedent-stage gear 103 directly meshing with the drum drive gear 104, the precedent-stage gear 103 and the drum drive gear 104 preferably satisfy a relation:

$$Z1/Z2=1/(N2\times N3)\ \text{(N3 being natural number)}$$

This relation allows to obtain a same rotation speed in the photosensitive drum 1, at an exposure (FIG. 13A) and at a transfer (FIG. 13B).

More specifically, the present embodiment adopts conditions of N2=2, Z1=30 and Z2=120. Therefore, in the present embodiment, there stands Z1/Z2=30/120=1/4=1/(2×N3) and N3 becomes 2.

It is thus possible, for each photosensitive drum 1, to cancel a rotation unevenness in the photosensitive drum 1 or an unevenness in the image pitch, caused by gear speed variation components in the drive train from the motor 101 as the drive source to the drum drive gear 104.

In the following, there will be explained a method for reducing a color misalignment among plural color images in the drum drive train Td.

For reducing a color misalignment among plural color images, following two points are important for the drum drive train Td:

(I) For all the plurality of image forming parts, the drum drive gear should have a same speed variation history (profile) per 1 rotation;

(II) In addition to (I), in all the plurality of image forming parts, the transfer should be executed at a same speed within the speed variation of the drum drive gear per 1 rotation.

Figure 15A:
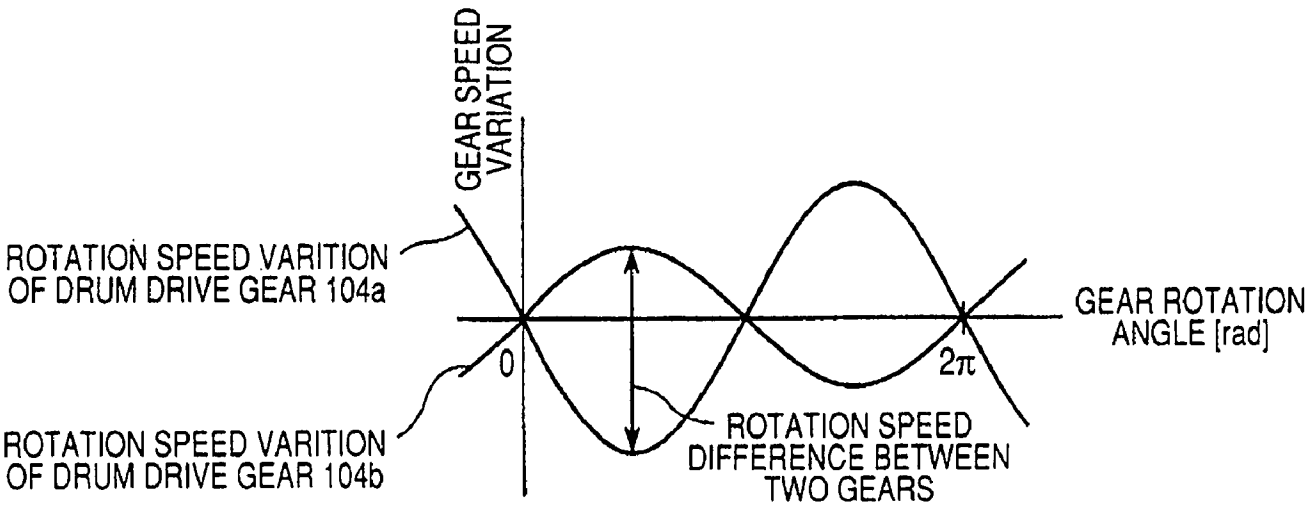
FIGS. 15A and 15B are charts showing an image color displacement between adjacent image forming parts.

With respect to (I), in case a plurality of image forming parts, for example two image forming parts Pa, Pb, have different speed variation profiles in the drum drive gears 104*a*, 104*b*, a speed difference is generated between the drum drive gears 104*a* and 104*b* of the two image forming parts Pa and Pb as shown in FIG. 15A, and such speed difference results in a color misalignment. In order to avoid such situation, it is preferable to employ, in all the image forming parts, gears of a same shape, prepared from a same mold or by a simultaneous integral working process.

Figure 14:
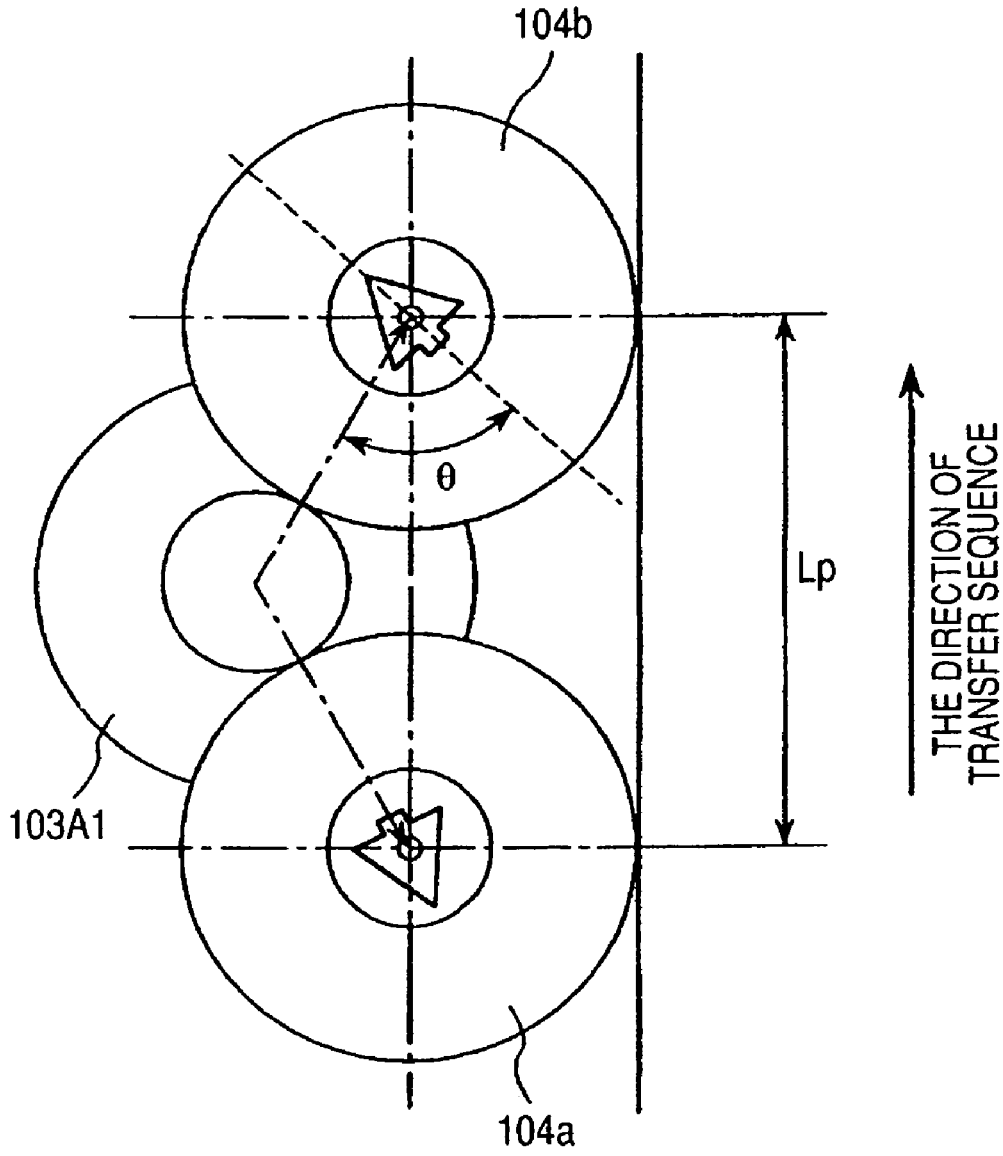
FIG. 14 is a view showing a distance between centers of photosensitive drums and a phase matching between adjacent drum driving gears.

With respect to (II), it is preferable, as shown in FIG. 14, to adopt a phase relationship in a combination of two adjacent drum drive gears 104*a*, 104*b*.

More specifically, in the two adjacent drum drive gears 104*a*, 104*b*, maximum distances in the eccentric directions are preferably not the same at least in an image forming operation. Also a maximum phase difference in the eccentric directions is preferably such that, with respect to meshing positions of the drum drive gears 104*a*, 104*b* with the precedent-stage gear 103A1, the phase relationship is advanced by an angle θ for the drum drive gear 104*b* corresponding to the photosensitive drum 1*b* which is later in the sequence of transfers. Such angle θ preferably satisfies, for a diameter d of the photosensitive drum and a distance Lp between the rotary centers of the adjacent photosensitive drums, a relation:

$$\theta=(\pi d-Lp)/\pi d\times 360[°]$$

It is thus rendered possible, between the adjacent image forming parts, to execute transfer operations with a same rotation speed of the drum drive gears, or with a same peripheral speed of the photosensitive drums. Based on such concept, the present embodiment is constructed with θ=16.2°, for conditions of d=25 mm and Lp=75 mm.

Figure 15B:
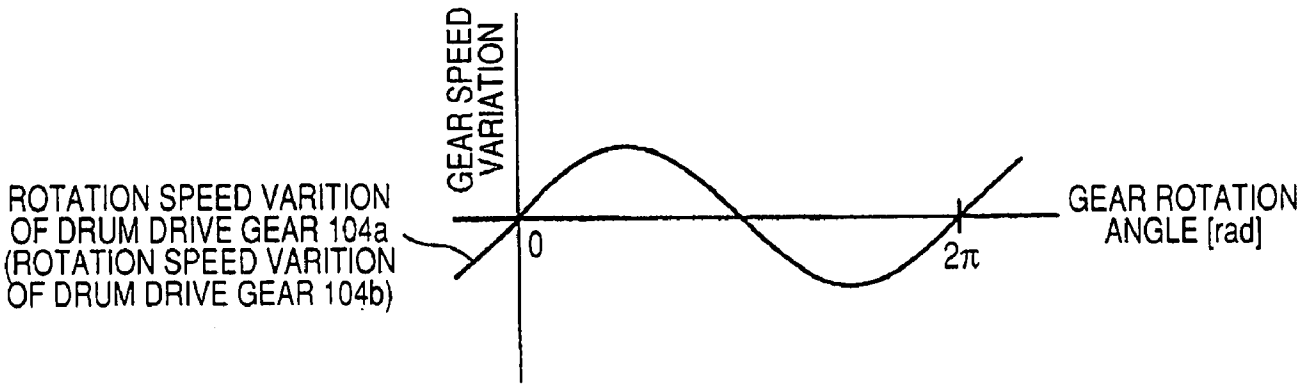

By matching the speed variation histories of plural gears and also forming a phase difference θ as described above, it is possible, as shown in FIG. 15B, to cancel the color misalignment by a difference in the rotation speeds between the plural drum drive gears 104*a* and 104*b*.

More specifically, in the present embodiment, a phase difference of an angle θ is realized in the following manner, between the drum drive gears of the adjacent image forming parts. At the side of the first motor 101A where the drive train is connected directly, the drum drive gears are assembled with a phase difference of an angle θ as described above. The side of the first motor 101A where the drive train is connected directly means the relationship between the drum drive gear 104*a* and the drum drive gear 104*b*, and the relationship between the drum drive gear 104*b* and the drum drive gear 104*c*.

However, because of the drive structure of the present embodiment described above, the phase difference of angle θ cannot be maintained, by such assembling with a phase difference, between the drum drive gear 104*c* and the drum drive gear 104*d* which are not directly connected. Therefore, the present embodiment adopts a phase matching by an electrical control, on the drum drive gear 104*c* and the drum drive gear 104*d*.

Figure 16:
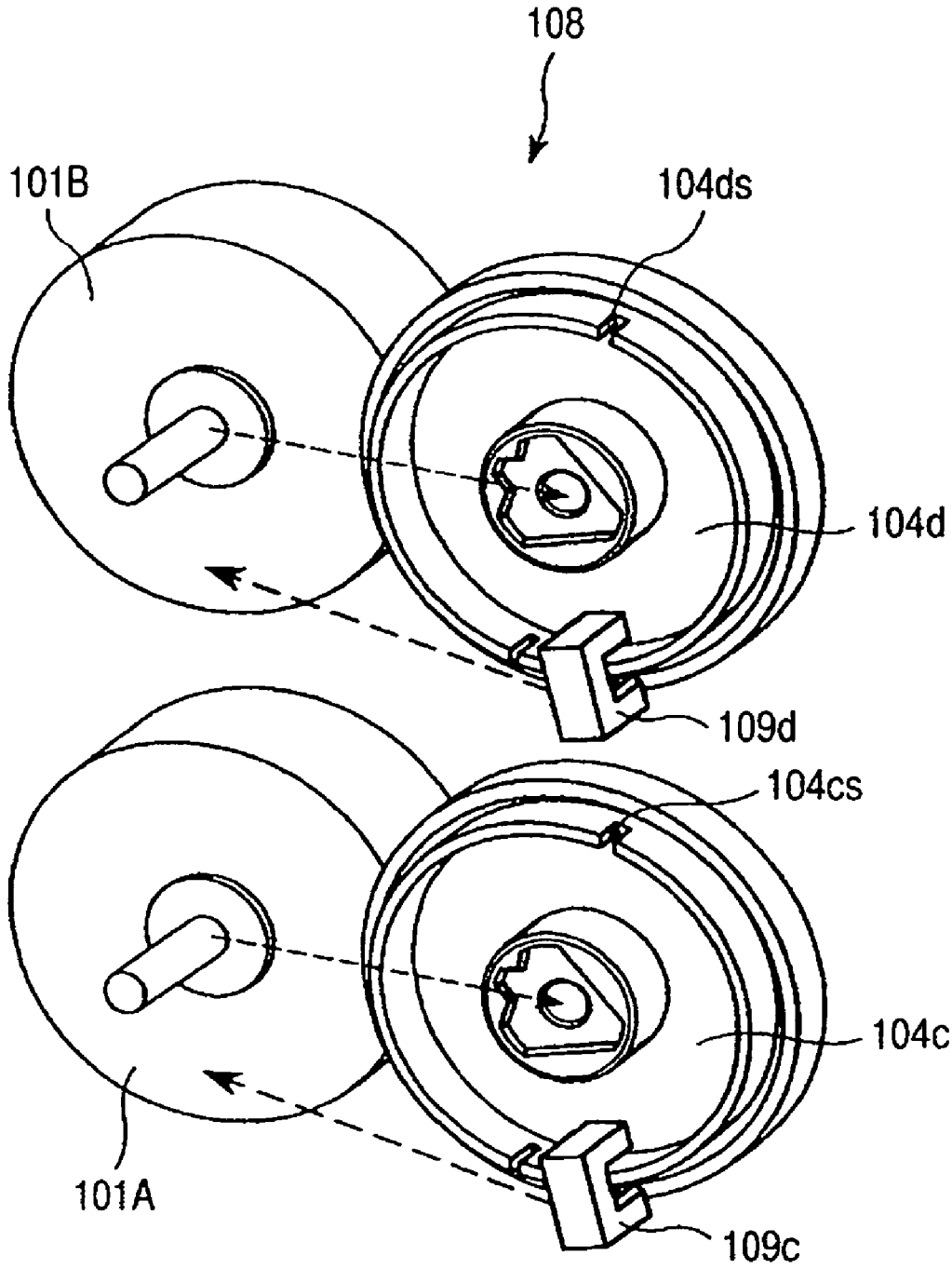
FIG. 16 is a view showing a phase matching apparatus.

FIG. 16 is a schematic view of a phase matching apparatus 108, provided in the image forming apparatus A of the present embodiment, for phase matching between the drum drive gear 104*c* and the drum drive gear 104*d*.

The drum drive gears 104*c*, 104*d* are respectively provided with slits 104*cs*, 104*ds* as detection parts for phase detection. Also in the vicinity of these slits 104*cs*, 104*ds*, photointerruptors (photosensors) 109*c*, 109*d* are provided as phase detection means. Outputs of the photointerruptors 109*c*, 109*d* are connected to the controller 200 of the engine control part, which controls the entire operations of the image forming apparatus A. Thus the controller 200 can recognize, during the rotation of the drum drive gears 104*c* and 104*d*, the timings of passing of the slits 104*cs*, 104*ds* through the photointerruptors 109*c*, 109*d*. Based on such timings, the controller 200 can know the phase difference between the drum drive gears 104*c*, 104*d*.

The controller 200 executes, through a motor control part, an electrical feedback control on the first and second motors 101A, 101B so as to obtain a desired phase difference between the drum drive gears 104*c* and 104*d*. In the present embodiment, the controller 200 checks such phase difference prior to an image forming operation, for example in an initializing operation of the apparatus, and executes the feedback control on the first and second motors 101A, 101B. Thus, in the present embodiment, the controller 200 has a function as phase matching control means for the drum drive gears 104*c* and 104*d*.

It is thus possible to form a phase difference of a predetermined angle θ between the plural drum drive gear, even in a drum drive train where the drive train is not directly connected and an assembling with a phase difference is not usable.

It is also preferable, in addition to the optimization of the conditions for rotation speed variation in the photosensitive drums, to also optimize conditions for rotation speed variation in the transfer belt 11.

More specifically, in order to reduce the color misalignment among the images of plural colors on the transfer material S, it is necessary that the conveying speed for the transfer material S, or the speed of the transfer belt 11, is the same at the transfer positions for the images of respective colors. For this purpose, a diameter D of the drive roller 13 for the transfer belt 11 (a shaft driving the transfer belt 11), a thickness t of the transfer belt 11, and a distance Lp between the rotary centers of the adjacent photosensitive drums preferably satisfy a relation:

$$Lp=\pi(D+t).$$

More specifically, in the present embodiment, the drive roller 13 has a diameter D of 23.8 mm, the transfer belt 11 has a thickness t of 110 μm, and the adjacent photosensitive drums have a distance Lp of 75 mm between the rotary centers.

It is thus rendered possible to maintain the transfer belt 11 at a same speed at the transfers of the images of respective colors, within a speed variation of the transfer belt 11 caused by a vibration of the drive roller 13.

Also in order to reduce the color misalignment, it is preferable to adopt a following condition, in addition to or in place for the aforementioned optimization of the speed variation conditions of the transfer belt 11.

More specifically, a distance between the transfer positions, of the toner image from the photosensitive drum to the transfer material S, between the two image forming parts adjacent in the conveying direction of the transfer material S, is preferably approximately an integral multiple of the external peripheral length of the drive roller 13 for the transfer belt 11 (shaft for driving the transfer belt 11).

More specifically, in the present embodiment, the distance between the transfer positions is the same as the distance between the rotary centers of the adjacent photosensitive drums, and is 75 mm. Also the drive roller 13 has a diameter of 23.8 mm. Therefore, the distance between the transfer positions is approximately 1 time of the external peripheral length of the drive roller 13.

As explained in the foregoing, the present embodiment adopts a "2-motor system" in the structure of drive power transmission relating to the image formation, to prevent the drawbacks in the "4-motor system" of a possibly higher cost, an increased weight of the apparatus and a possibly larger space occupied by the drive apparatus, and to prevent the drawbacks of an aggravation in the color misalignment and in the banding phenomenon, resulting from an uneven rotation of the photosensitive member caused by a meshing in the clutch, which is required in the drum drive train in the "1-motor system", thereby allowing to provide an image forming apparatus, capable of achieving a low cost and a high image quality.

The present embodiment adopts a "2-motor system", in which a single motor 101A drives at least the photosensitive drums 1*a*, 1*b* and 1*c* for Y, M and C colors, and another motor 101B drives the photosensitive drum 1*d* for Bk color and the developing roller 40*d*. It is thus made possible to flexibly achieve a multi-color/mono-color mode switching involving contact/separation of transfer belt and photosensitive drums, and to control the image forming operation in each mode. It is thus made possible to reduce the operating noises in a mono-color image output and to avoid wasting the service lives of the transfer belt and the process cartridge, thus providing images of a high image quality until the end of the service life of the image forming apparatus.

Also since one motor 101A drives 3 photosensitive drums and 1 developing roller while the other motor 101B drives 1 photosensitive drum and 3 developing rollers, the motors have approximately equalized loads, so that same motors may be employed to improve the cost and the assembling property.

Embodiment 2

In the following description, another embodiment of the present invention will be explained. As the image forming apparatus of the present embodiment has a basic structure similar to that of the embodiment 1. Therefore, components of function or structure the same or similar to those in embodiment 1 will be represented by the same symbols and will not be explained in detail, and description will be made on different parts.

In embodiment 1, the developing roller 40*a* for yellow color is driven by the first motor 101A, while the developing rollers 40*b*, 40*c* and 40*d* for M, C and Bk colors are driven by the second motor 101B. Also in consideration of the service life of the developing units, during the image output in the multi-color mode, the developing rollers 40*b* and 40*c* for M and C colors are separated from the photosensitive drums 1*b* and 1*c*, and are interrupted from the drive power transmission. In such case, a load change may be generated in the second motor 101B, eventually leading to a local speed variation in the photosensitive drum 1*b* or a shock to the entire image forming apparatus A. Therefore, an image defect may be induced in an extreme case.

In case the transmission of drive power to the developing rollers 40*b* and 40*c* for M and C colors is not interrupted until the completion of the transfer step of the photosensitive drum 1*d* in order to avoid such phenomenon, there results a waste of service life particularly in the process cartridges 7*b* and 7*c* for M and C colors.

Figure 17:
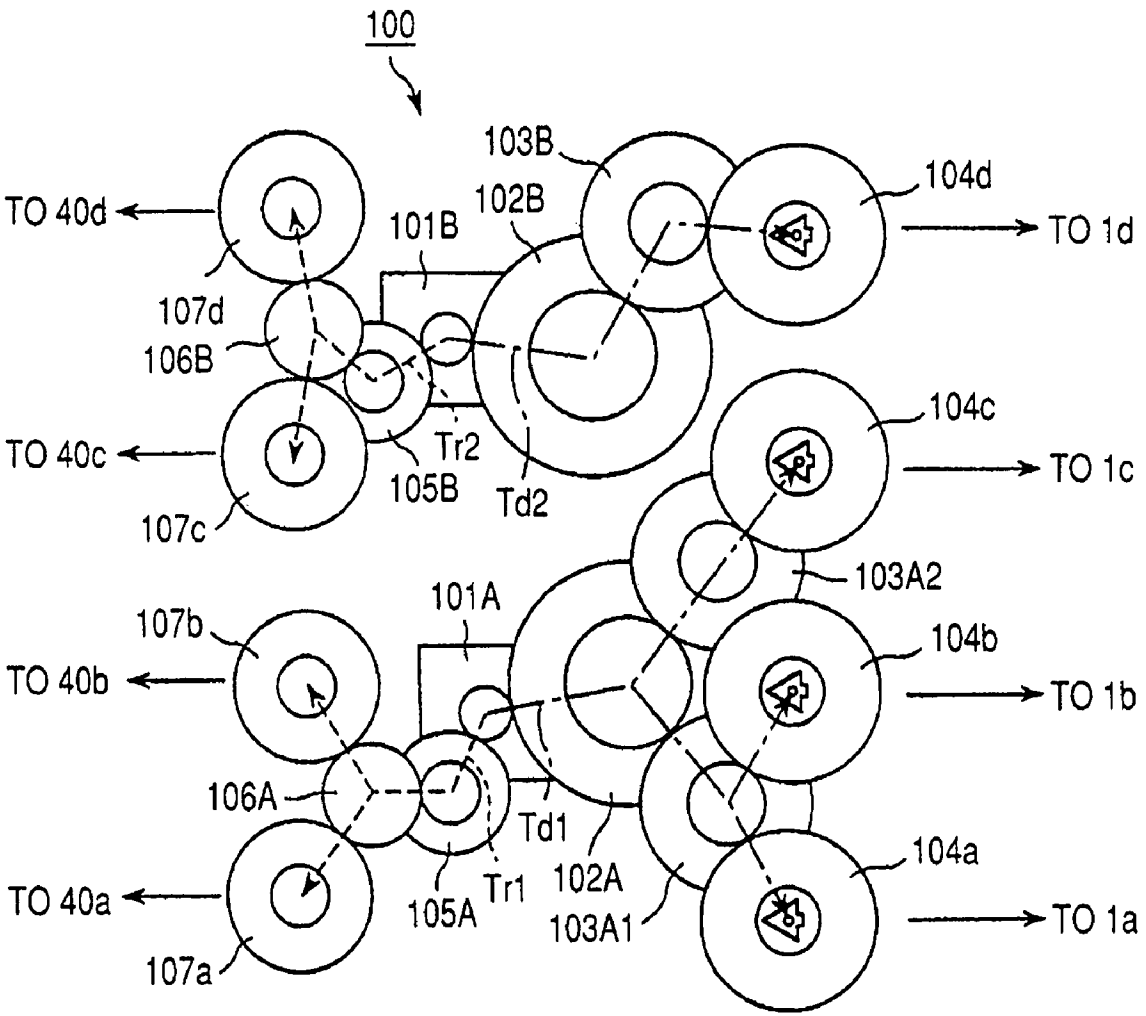
FIG. 17 is a view showing a drive system for photosensitive drums and developing rollers in another embodiment of the present invention.
Figure 18:
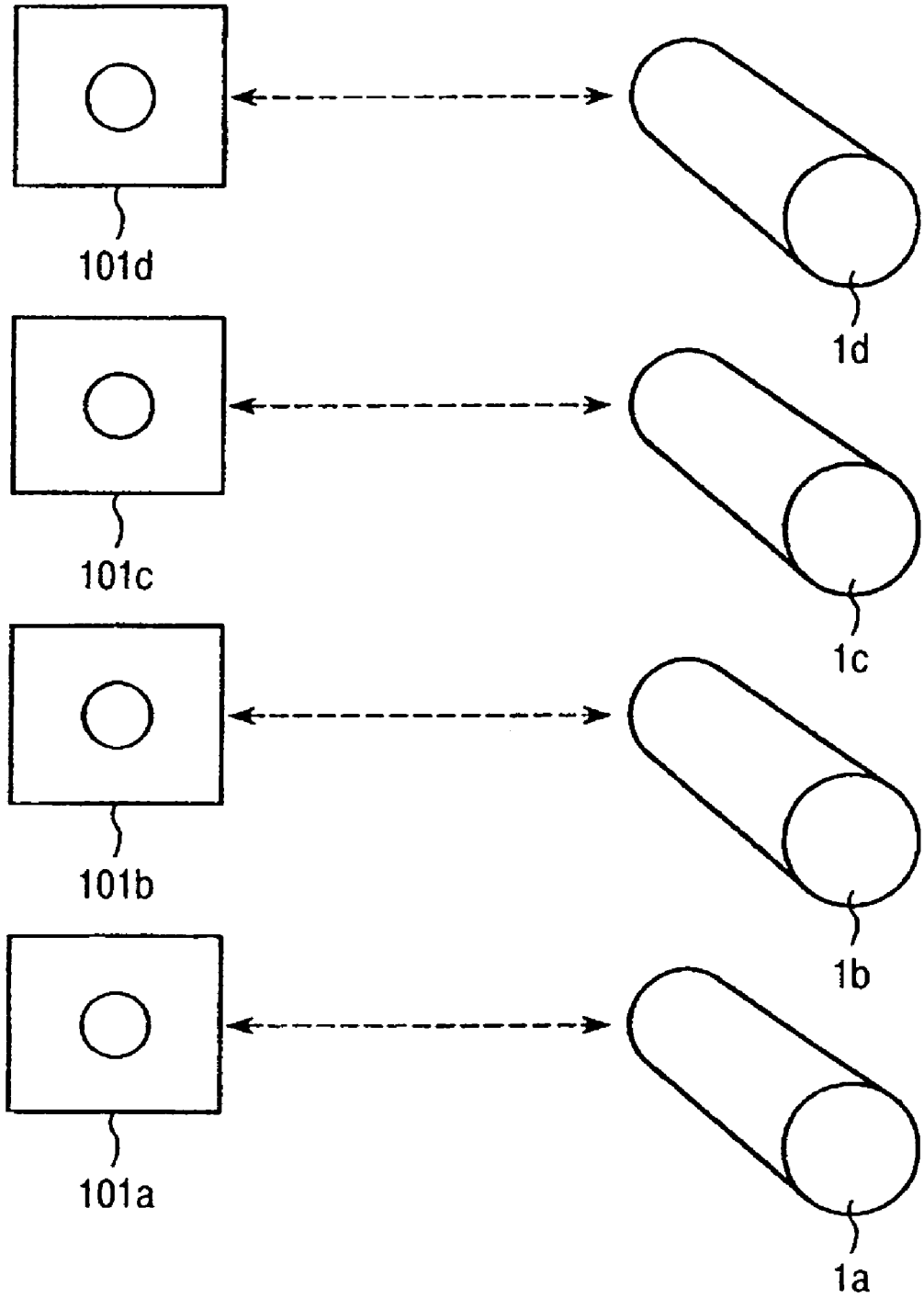
FIG. 18 is a conceptual view showing a drive structure for process cartridges in a 4-motor system.
Figure 19:
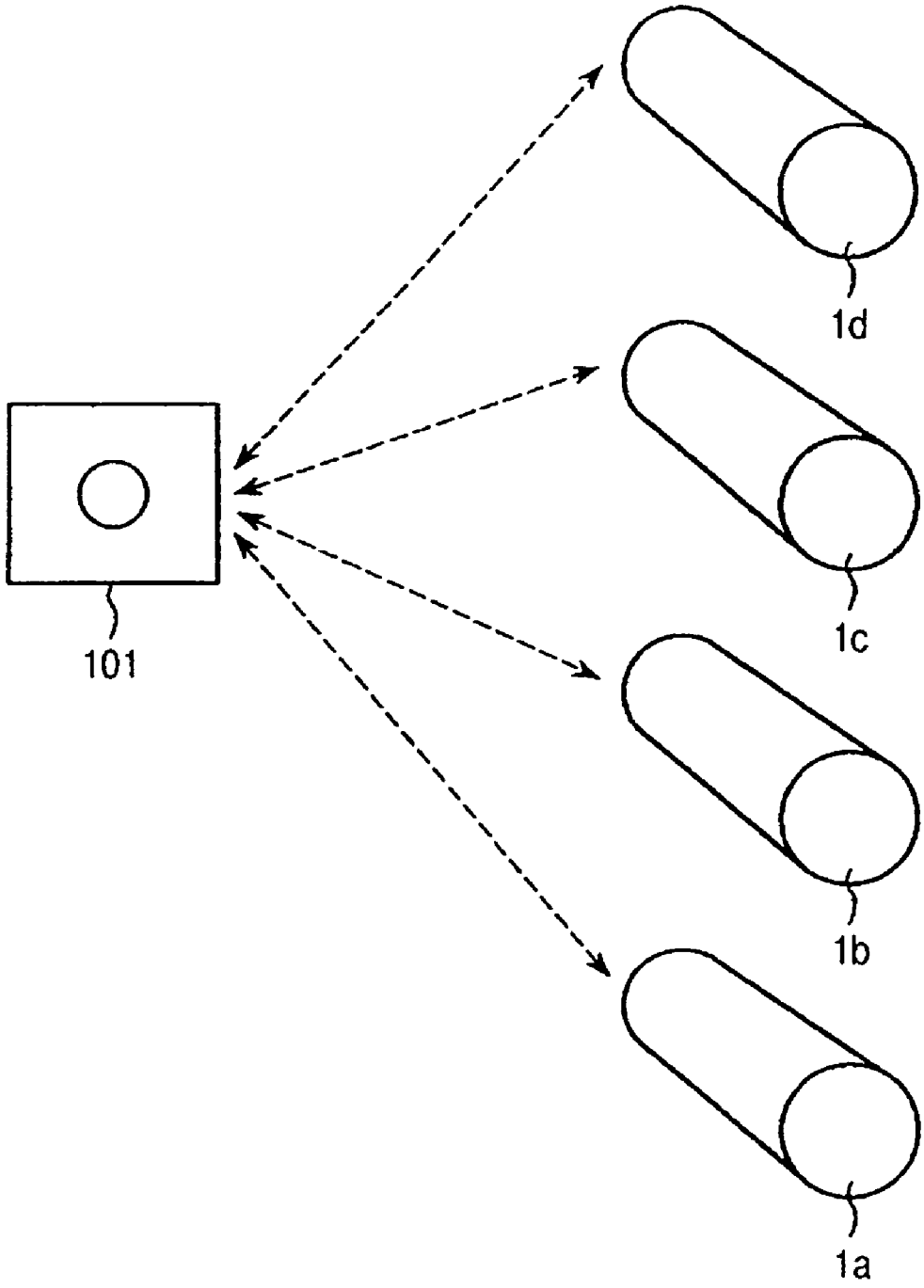
FIG. 19 is a conceptual view showing a drive structure for process cartridges in a 1-motor system.

This, in the embodiment, as shown in FIG. 17, the developing rollers 40*a*, 40*b* for Y and M colors are driven by the first motor 101A, while the developing rollers 40*c*, 40*d* for C and Bk colors are driven by the second motor 101B.

In the present embodiment, the first motor 101A is connected, along a first developing roller drive train Tr1 and through a first-stage idler gear 105A and a second-stage idler gear 106A, to clutch gears 107*a*, 107*b* for Y and M colors. Finally it meshes with input gears of the process cartridges 7*a*, 7*b* for Y and M color images, thereby driving the developing rollers 40*a* and 40*b*. On the other hand, the second motor 101B is connected, along a second developing roller drive train Tr2 and through a first-stage idler gear 105B and a second-stage idler gear 106B, to clutch gears 107*c*, 107*d* for C and Bk colors. Finally it meshes with input gears of the process cartridges 7*c*, 7*d* for C and Bk color images, thereby driving the developing rollers 40*c* and 40*d*.

In order to avoid a shock, the drive of each developing roller is not stopped until the completion of a transfer step of an image from a photosensitive drum, driven by the first or second motor 101A or 101B which transmits the drive power to such developing roller.

In the present embodiment of such structure, it is only necessary, in the image forming parts Pc and Pd for C and Bk color images, to delay the separation of the developing roller for C color until the completion of the transfer step in the image forming part for Bk color. It is thus possible to suppress a waste in the service life of the process cartridge.

Embodiment 3

In the following description, still another embodiment of the present invention will be explained. As the image forming apparatus of the present embodiment has a basic structure similar to that of the embodiment 1. Therefore, components of function or structure the same or similar to those in embodiment 1 will be represented by the same symbols and will not be explained in detail, and description will be made on different parts.

A drive structure other than those in embodiments 1 and 2 may be employed for the developing rollers 40*a*, 40*b* and 40*c* for Y, M and C colors, if a certain margin is available in a motor output or in a service life of the process cartridge including the developing roller and the like. For example, all the developing rollers 40*a*, 40*b* and 40*c* for Y, M and C colors may be driven by the second motor 101B.

Thus, the present invention is applicable by driving the developing rollers 40*a*, 40*b* and 40*c* for Y, M and C colors either by the first motor 101A or by the second motor 101B. Also in such case, as in the aforementioned embodiments 1 and 2, the drum drive train does not require a clutch mechanism for switching the mono-color/multi-color mode, and the drawbacks of aggravation in banding or color misalignment can be avoided.

Also in certain cases, there may be employed a structure having a clutch mechanism each in a drive train for the developing roller 40*d* for Bk color and in the developing rollers 40*a*, 40*b* and 40*c* for Y, M and C colors. It is thus possible to dispense with 2 clutches among 3 colors of Y, M and C, thereby achieving a cost reduction. Also a flexible control is possible for an image output mode in which, in a mono-color mode, the photosensitive drums are contacted with the transfer belt 11 in plural positions and are rotated, in order to improve the conveying property for the transfer material S.

While the present invention has been described with reference to specific embodiments, it is to be understood that the invention is not limited to the disclosed embodiments. For example, embodiments 1-3 assume an image forming apparatus of a direct transfer type, in which toner images are transferred in succession from a plurality of photosensitive drums onto a transfer material, conveyed by a transfer belt, thereby forming a recorded image.

Figure 21:
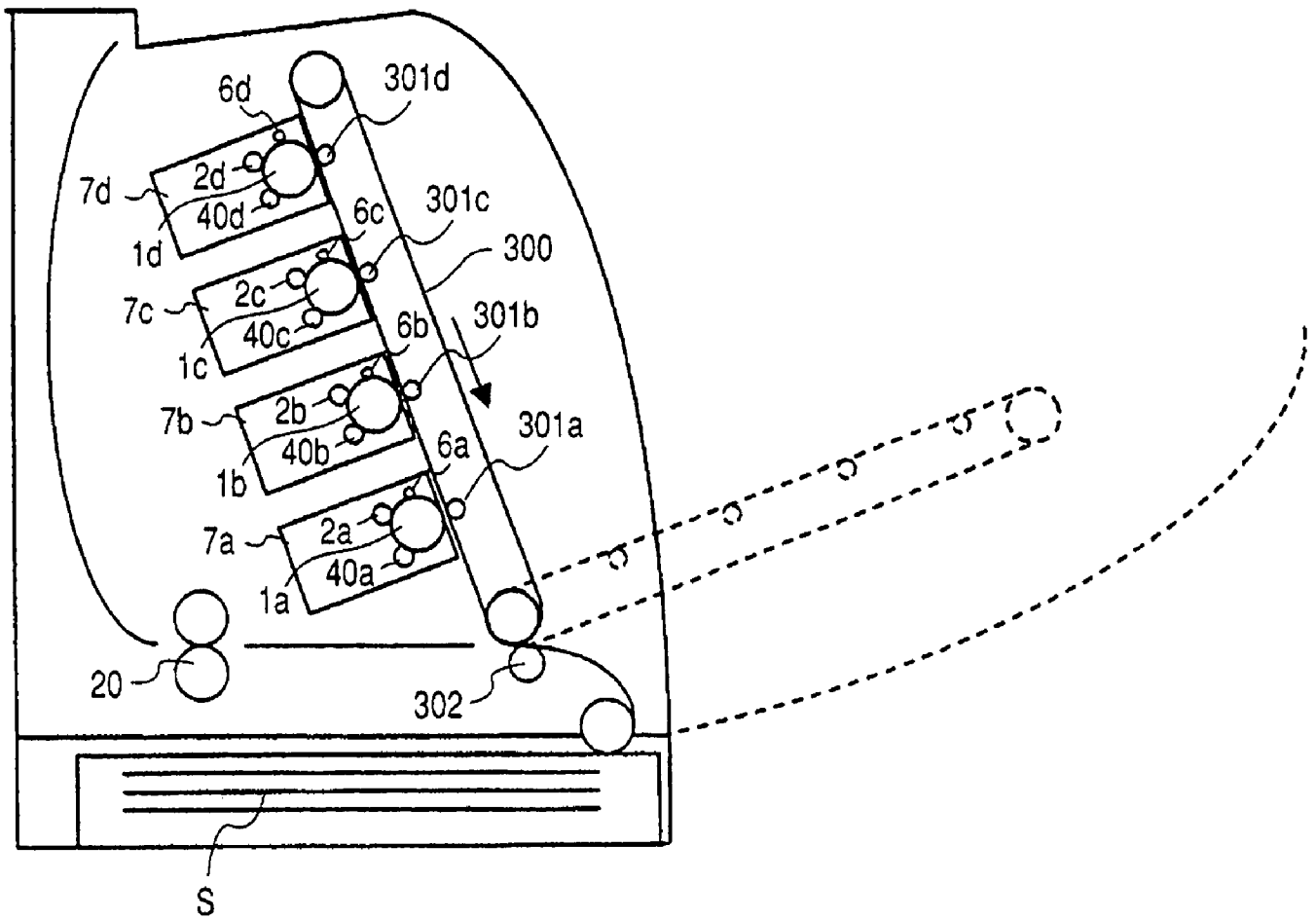
FIG. 21 is a view showing another image forming apparatus in which the present invention is applicable.

However, the present invention is not limited to an image forming apparatus utilizing a transfer belt. For example, FIG. 21 shows an image forming apparatus of an intermediate transfer type. The image forming apparatus of such intermediate transfer type includes a plurality of image forming parts 7*a*, 7*b*, 7*c* and 7*d*, respectively having, for example, photosensitive drums 1*a*, 1*b*, 1*c* and 1*d*, and, as process means acting on such photosensitive drums 1*a*, 1*b*, 1*c* and 1*d*, charging devices 2*a*, 2*b*, 2*c* and 2*d*, developing devices 40*a*, 40*b*, 40*c* and 40*d*, and cleaning devices 6*a*, 6*b*, 6*c* and 6*d*. The toner images on the photosensitive drums 1*a*, 1*b*, 1*c* and 1*d* are transferred, in succession and in superposition by primary transfer rollers 301*a*, 302*b*, 302*c* and 302*d*, onto an intermediate transfer member 300 forming a transfer-receiving member which cyclically moves in opposition to the image forming parts (for example an intermediate transfer belt formed as an endless belt). Thereafter, such toner images are subjected to a collective secondary transfer, by means of a secondary transfer roller 302, onto a transfer material S conveyed by a separate transfer material conveying system. Thereafter the transfer material S passes through a fixing device 20 whereby an image is formed on the transfer materials. It will be evident from the foregoing description, that the present invention is likewise applicable to an image forming apparatus such as an intermediate transfer system and provides effects as described above.

Also the order of toner images to be transferred from the plurality of image forming parts to the transfer-receiving member is not limited to those in the foregoing embodiments. More specifically, in the image forming apparatus of the foregoing embodiments, the image forming parts for forming the images of Y, M, C and Bk colors may be arranged in an arbitrary order along the conveying direction of transfer-receiving member.

Also the aforementioned embodiments assume presence of 4 image forming parts corresponding to Y, M, C and Bk colors, but the present invention is applicable when at least 3 image forming parts are present, and the effects of the present invention can be attained by driving 2 photosensitive drums by a first motor and driving 1 photosensitive drum and at least 2 developing rollers with a second motor.

Also the foregoing embodiments have been explained with the developing rollers as an example of driven members, but the driven members may be any driven members acting on the photosensitive drums, such as charging rollers or cleaning members.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-226044, filed Aug. 3, 2005 and Japanese Patent Application No. 2006-206710, filed Jul. 28, 2006 which are hereby incorporated by reference herein in their entirety.

What is claimed is:

1. An image forming apparatus comprising:

a plurality of image bearing members on each of which a toner image is formed, said plurality of image bearing members including a plurality of first image bearing members and a second image bearing member which is different from said plurality of first image bearing members;

a plurality of driven members, each of which, respectively, acts on each of said plurality of image bearing members, wherein, in a first mode, the toner image is formed on each of said plurality of first image bearing members and said second image bearing member, and in a second mode, the toner image is not formed on said plurality of first image bearing members and the toner image is formed on said second image bearing member;

a first drive device which drives said plurality of first image bearing members; and a second drive device which drives said second image bearing member, a driven member of said plurality of driven members which acts on said second image bearing member and at least one other of said plurality of driven members.

2. An image forming apparatus according to claim 1, wherein said first drive device drives at least one of said plurality of driven members.

3. An image forming apparatus according to claim 1, wherein a number of said plurality of image bearing members and said plurality of driven members to which said first drive device supplies power is a same as a number of said plurality of image bearing members and said plurality of driven members to which said second drive device supplies power.

4. An image forming apparatus according to claim 1, wherein said first drive device drives three of said plurality of said first image bearing members and one driven member of said plurality of driven members, and said second drive device drives said second image bearing member and three other driven members of said plurality of driven members.

5. An image forming apparatus according to claim 1, wherein said first drive device drives three of said plurality of said first image bearing members and two driven members of said plurality of driven members, and said second drive device drives said second image bearing member and two other driven members of said plurality of driven members.

6. An image forming apparatus according to claim 1, wherein said first drive device drives three of said plurality of said first image bearing members, and said second drive device drives said second image bearing member and four driven members of said plurality of driven members.

7. An image forming apparatus according to claim 1, wherein the first mode is a full-color mode, and the second mode is a mono-color mode.

8. An image forming apparatus according to claim 1, wherein toner images of yellow, magenta and cyan colors are formed on three of said plurality of first image bearing members, respectively, and a toner image of black color is formed on said second image bearing member.

9. An image forming apparatus according to claim 1, wherein said plurality of image bearing members are driven in rotation by said first and second drive devices, each of said first and second drive devices including:

a motor for generating a rotary drive force, a motor gear provided concentrically with said motor, a drive gear provided concentrically with an image bearing member of said plurality of image bearing members, for driving said image bearing member, and a precedent-stage gear directly meshing with said drive gear, wherein the drive force is transmitted by a gear train from said motor gear through said precedent-stage gear to said drive gear, and said gear train is connected with a teeth number ratio 1/N1, where N1 is a natural number, among mutually meshing gears from said motor gear to said precedent-stage gear and an angle between an exposure point and a transfer point of each of said image bearing members with respect to a rotary center of said image bearing member is 360°/N2, where N2 is a natural number, and satisfies the relationship Z1/Z2=1/(N2×N3), where N3 is also a natural number, in which Z2 indicates a number of teeth of said drive gear and Z1 indicates a number of teeth of said precedent-stage gear.

10. An image forming apparatus according to claim 9, wherein said drive gears for all of said plurality of image bearing members are gears of a same shape formed by a same mold or by a simultaneous integral working process.

11. An image forming apparatus according to claim 9, wherein drive gears for two adjacent ones of said plurality of image bearing members have a maximum phase difference in eccentric directions is such that, with respect to meshing positions of said drive gears with said precedent-stage gear, a phase relationship is advanced by an angle θ for said drive gear corresponding to said image bearing member which is later in a sequence of transfers, the angle θ satisfying, for a diameter d of said image bearing member and a distance Lp between rotary centers of adjacent one of said image bearing members, the following relationship:

$$\theta=(\pi d-Lp)/\pi d\times 360°.$$

12. An image forming apparatus according to claim 11, wherein said drive gears of said two adjacent ones of image bearing members among said plurality of first image bearing members are assembled with a phase difference of the angle θ.

13. An image forming apparatus according to claim 11, further comprising a control device for controlling said first drive device and said second drive device, in such a manner that said drive gears for said two adjacent ones of image bearing members, including one drive gear among said plurality of first image bearing members and a drive gear for said second image bearing member, have a phase difference of the angle θ.

14. An image forming apparatus according to claim 1, further comprising a transfer device for transferring toner images on said plurality of image bearing members onto a recording material;

wherein in the first mode, said plurality of image bearing members are contacted with said transfer device, and in the second mode, said plurality of first image bearing members are separated from said transfer device while said second image bearing member is contacted with said transfer device.

15. An image forming apparatus according to claim 14, wherein said plurality of image bearing members are driven in rotation, said transfer device is formed by an endless belt, and a diameter D of a shaft for driving said belt, a thickness t of said belt and a distance Lp between rotary centers of two adjacent one of said plurality of first image bearing members satisfy the following relationship:

$$Lp=\pi(D+t).$$

16. An image forming apparatus according to claim 14, wherein said transfer device is formed by an endless belt, and a distance between transfer positions of toner images from said plurality of image bearing members to said transfer device, for two adjacent image bearing members, is an integral multiple of an external peripheral length of a shaft driving said belt.

17. An image forming apparatus according to claim 14, wherein said transfer device is a recording material carrying member.

18. An image forming apparatus according to claim 14, wherein said transfer device is an intermediate transfer member which temporarily bears the toner image of said plurality of image bearing members before a transfer onto a recording material.

19. An image forming apparatus according to claim 1, wherein a clutch device is provided in a drive train for transmitting a drive force to at least one of said plurality of driven members, and, in said image bearing member on which a driven member being provided with said clutch device acts, said driven member is driven with a timing different from a drive timing of other ones of said plurality of image bearing members.

20. An image forming apparatus according to claim 1, wherein each of said plurality of image bearing members and each of said plurality of driven members are integrally formed as a cartridge which is detachably mountable in a main body of the apparatus.

21. An image forming apparatus according to claim 1, wherein each of said plurality of driven members is one of a developing member, a charging member and a cleaning member.

* * * * *